US010451997B1

(12) United States Patent
Leemhuis et al.

(10) Patent No.: US 10,451,997 B1
(45) Date of Patent: Oct. 22, 2019

(54) TONER LEVEL DETECTION MEASURING AN ORIENTATION OF A ROTATABLE MAGNET HAVING A VARYING ORIENTATION RELATIVE TO A PIVOT AXIS

(71) Applicant: LEXMARK INTERNATIONAL, INC., Lexington, KY (US)

(72) Inventors: Michael Craig Leemhuis, Nicholasville, KY (US); Gary Allen Denton, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 16/041,075

(22) Filed: Jul. 20, 2018

(51) Int. Cl.
*G03G 15/10* (2006.01)
*G03G 15/08* (2006.01)

(52) U.S. Cl.
CPC ..... *G03G 15/086* (2013.01); *G03G 15/0867* (2013.01)

(58) Field of Classification Search
CPC ..... G03G 15/086; G03G 15/0856; G03G 15/0889; G03G 15/0867
See application file for complete search history.

(56) References Cited

U.S. PATENT DOCUMENTS 3,920,155 A 11/1975 Whited
3,979,022 A 9/1976 Whited
4,506,804 A 3/1985 Oka
4,592,642 A 6/1986 Imaizumi et al.
4,989,754 A 2/1991 Grasso et al.
5,111,247 A 5/1992 Nichols
5,216,462 A 6/1993 Nakajima et al.
5,237,372 A 8/1993 Ishii et al.
5,383,007 A 1/1995 Kinoshita et al.
5,436,704 A 7/1995 Moon
(Continued)

FOREIGN PATENT DOCUMENTS

CN 2454308 Y 10/2001
JP S55-143410 A 11/1980
(Continued)

OTHER PUBLICATIONS

JPO Machine translation of JP 3351179B2.
(Continued)

*Primary Examiner* — Hoang X Ngo

(57) ABSTRACT

A toner level detection assembly for an electrophotographic image forming device according to one example embodiment includes a magnet connected to a rotatable shaft and rotatable with the shaft around an axis of rotation of the shaft. The magnet is pivotable independent of the shaft about a pivot axis that is spaced radially from the axis of rotation. A magnetic sensor is positioned to sense a magnetic field of the magnet at a point in a rotational path of the magnet and is configured to measure an orientation of the magnetic field of the magnet at the point in the rotational path of the magnet. Processing circuitry in communication with the magnetic sensor is configured to determine an estimate of an amount of toner in a toner reservoir correlating with the measured orientation of the magnetic field of the magnet at the point in the rotational path of the magnet.

10 Claims, 18 Drawing Sheets

(56) References Cited

U.S. PATENT DOCUMENTS

| | | | |
|---|---|---|---|
| 5,587,770 | A | 12/1996 | Jo et al. |
| 5,634,169 | A | 5/1997 | Barry et al. |
| 5,995,772 | A | 11/1999 | Barry et al. |
| 6,032,004 | A | 2/2000 | Mirabella, Jr. et al. |
| 6,100,601 | A | 8/2000 | Baker et al. |
| 6,246,841 | B1 | 6/2001 | Merrifield et al. |
| 6,336,015 | B1 | 1/2002 | Numagami |
| 6,343,883 | B1 | 2/2002 | Tada et al. |
| 6,397,018 | B1 | 5/2002 | Matsumoto et al. |
| 6,459,876 | B1 | 10/2002 | Buchanan et al. |
| 6,496,662 | B1 | 12/2002 | Buchanan et al. |
| 6,510,291 | B2 | 1/2003 | Campbell et al. |
| 6,546,213 | B2 | 4/2003 | Ito et al. |
| 6,580,881 | B2 | 6/2003 | Coriale et al. |
| 6,600,882 | B1 | 7/2003 | Applegate et al. |
| 6,654,569 | B2 | 11/2003 | Nozawa |
| 6,718,147 | B1 | 4/2004 | Carter et al. |
| 6,819,884 | B1 | 11/2004 | Carter et al. |
| 6,972,558 | B1 | 12/2005 | Robinson |
| 7,103,308 | B2 | 9/2006 | Wakana |
| 7,139,505 | B2 | 11/2006 | Askren et al. |
| 7,177,567 | B2 | 2/2007 | Miller |
| 7,187,876 | B2 | 3/2007 | Ito et al. |
| 7,231,153 | B2 | 6/2007 | May |
| 7,248,806 | B2 | 7/2007 | Askren et al. |
| 7,399,074 | B2 | 7/2008 | Aldrich et al. |
| 7,551,862 | B2 | 6/2009 | Tanaka et al. |
| 7,555,231 | B2 | 6/2009 | Etter et al. |
| 7,782,198 | B2 | 8/2010 | Crockett et al. |
| 8,208,836 | B2 | 6/2012 | Shimomura |
| 8,401,440 | B2 | 3/2013 | Oba et al. |
| 8,417,157 | B2 | 4/2013 | Saito et al. |
| 8,482,523 | B2 | 7/2013 | Didier et al. |
| 8,594,526 | B2 | 11/2013 | Mushika et al. |
| 8,718,496 | B2 | 5/2014 | Barry et al. |
| 8,971,772 | B2 | 3/2015 | Senda et al. |
| 9,335,656 | B2 | 5/2016 | Carpenter et al. |
| 9,389,582 | B2 | 7/2016 | Carpenter et al. |
| 9,519,243 | B2 | 12/2016 | Carpenter et al. |
| 9,841,722 | B2 | 12/2017 | Carpenter et al. |
| 9,869,950 | B1 | 1/2018 | Leemhuis |
| 9,983,506 | B2 * | 5/2018 | Carpenter ..... G03G 15/086 |
| 2001/0051051 | A1 | 12/2001 | Matsumoto |
| 2002/0091413 | A1 | 7/2002 | Cappa et al. |
| 2002/0168192 | A1 | 11/2002 | Surya et al. |
| 2006/0000279 | A1 | 1/2006 | Jamnia et al. |
| 2006/0198643 | A1 | 9/2006 | Kimura et al. |
| 2006/0291910 | A1 | 12/2006 | Choi et al. |
| 2007/0196137 | A1 | 8/2007 | Hebner et al. |
| 2008/0226351 | A1 | 9/2008 | Dawson et al. |
| 2008/0247784 | A1 | 10/2008 | Kakuta et al. |
| 2009/0185833 | A1 | 7/2009 | Shimomura |
| 2009/0190938 | A1 | 7/2009 | Teramura |
| 2010/0202798 | A1 | 8/2010 | Suzuki et al. |
| 2010/0303484 | A1 | 12/2010 | Hogan et al. |
| 2011/0206389 | A1 | 8/2011 | Naruse |
| 2011/0206391 | A1 | 8/2011 | Naruse |
| 2011/0311270 | A1 | 12/2011 | Takagi et al. |
| 2012/0045224 | A1 | 2/2012 | Amann et al. |
| 2012/0070162 | A1 | 3/2012 | Barry |
| 2012/0099900 | A1 | 4/2012 | Noguchi et al. |
| 2012/0170948 | A1 | 7/2012 | Kwon et al. |
| 2013/0004208 | A1 | 1/2013 | Shimomura |
| 2013/0039670 | A1 | 2/2013 | Hosoya et al. |
| 2013/0202275 | A1 | 8/2013 | Brown et al. |
| 2013/0257455 | A1 | 10/2013 | Ahne et al. |
| 2013/0343777 | A1 | 12/2013 | Amann et al. |
| 2014/0029960 | A1 | 1/2014 | Ahne et al. |
| 2014/0037305 | A1 | 2/2014 | Monde et al. |
| 2014/0079438 | A1 | 3/2014 | Abler et al. |
| 2014/0105619 | A1 | 4/2014 | Elliott et al. |
| 2014/0105620 | A1 | 4/2014 | Elliott et al. |
| 2014/0105622 | A1 | 4/2014 | True et al. |
| 2014/0169806 | A1 | 6/2014 | Leemhuis et al. |
| 2014/0169807 | A1 | 6/2014 | Leemhuis et al. |
| 2014/0169808 | A1 | 6/2014 | Leemhuis et al. |
| 2014/0169810 | A1 | 6/2014 | Leemhuis et al. |
| 2014/0205305 | A1 | 7/2014 | Leemhuis et al. |
| 2014/0212155 | A1 | 7/2014 | Leemhuis et al. |
| 2014/0226994 | A1 | 8/2014 | Leemhuis et al. |
| 2016/0216641 | A1 | 7/2016 | Makie et al. |
| 2018/0059613 | A1 | 3/2018 | Carpenter et al. |

FOREIGN PATENT DOCUMENTS

| | | | |
|---|---|---|---|
| JP | S60-107664 | A | 6/1985 |
| JP | S60-230166 | A | 11/1985 |
| JP | H04-358179 | A | 12/1992 |
| JP | H05-046026 | A | 2/1993 |
| JP | 2000-155461 | A | 6/2000 |
| JP | 2001-194877 | A | 7/2001 |
| JP | 2002-108086 | A | 4/2002 |
| JP | 2002-132036 | A | 5/2002 |
| JP | 3351179 | B2 | 11/2002 |
| JP | 2005-208121 | A | 8/2005 |
| JP | 2007-192852 | A | 8/2007 |
| JP | 2010-175768 | A | 8/2010 |
| WO | 2012144324 | A1 | 10/2012 |

OTHER PUBLICATIONS

JPO Machine translation of JP 2002-108086A.
JPO Machine translation of JP 2000-155461A.
JPO Machine translation of JP S60-107664A.
JPO Machine translation of JP 2007-192852A.
JPO Machine translation of JP S55-143410A.
JPO Machine translation of JP H04-358179A.
JPO Machine translation of JP H05-046026A.
JPO Machine translation of JP 2002-132036A.
U.S. Appl. No. 16/027,643, filed Jul. 5, 2018 (Leemhuis et al.).
U.S. Appl. No. 16/027,657, filed Jul. 5, 2018 (Leemhuis et al.).
JPO Machine translation of JP 2001-194877A.
U.S. Appl. No. 16/041,048, filed Jul. 20, 2018 (Leemhuis).
U.S. Appl. No. 16/041,089, filed Jul. 20, 2018 (Leemhuis et al.).
U.S. Appl. No. 16/041,109, filed Jul. 20, 2018 (Leemhuis et al.).
EPO machine translation of CN 2454308 Y (Pason).
EPO machine translation of JP S60-230166 A (Akiyama et al.).
EPO machine translation of JP 2005-208121 A (Kawai).
EPO machine translation of JP 2010-175768 A (Umeno).
Non-Final Office Action dated Mar. 6, 2019 for U.S. Appl. No. 16/041,089 (Leemhuis et al.).
Final Office Action dated Jun. 27, 2019 for U.S. Appl. No. 16/041,089 (Leemhuis et al.).

* cited by examiner

TONER LEVEL DETECTION MEASURING AN ORIENTATION OF A ROTATABLE MAGNET HAVING A VARYING ORIENTATION RELATIVE TO A PIVOT AXIS

CROSS REFERENCES TO RELATED APPLICATIONS

None.

BACKGROUND

1. Field of the Disclosure

The present disclosure relates generally to image forming devices and more particularly to toner level detection measuring an orientation of a rotatable magnet having a varying orientation relative to a pivot axis.

2. Description of the Related Art

During the electrophotographic printing process, an electrically charged rotating photoconductive drum is selectively exposed to a laser beam. The areas of the photoconductive drum exposed to the laser beam are discharged creating an electrostatic latent image of a page to be printed on the photoconductive drum. Toner particles are then electrostatically picked up by the latent image on the photoconductive drum creating a toned image on the drum. The toned image is transferred to the print media (e.g., paper) either directly by the photoconductive drum or indirectly by an intermediate transfer member. The toner is then fused to the media using heat and pressure to complete the print.

The image forming device's toner supply is typically stored in one or more replaceable units installed in the image forming device. As these replaceable units run out of toner, the units must be replaced or refilled in order to continue printing. As a result, it is desired to measure the amount of toner remaining in these units in order to warn the user that one of the replaceable units is near an empty state or to prevent printing after one of the units is empty in order to prevent damage to the image forming device. Accordingly, a system for measuring the amount of toner remaining in a replaceable unit of an image forming device is desired.

SUMMARY

A toner level detection assembly for an electrophotographic image forming device according to one example embodiment includes a reservoir for storing toner. A rotatable shaft is positioned within the reservoir and has an axis of rotation. A magnet is connected to the rotatable shaft and is rotatable with the rotatable shaft around the axis of rotation. The magnet is pivotable independent of the rotatable shaft about a pivot axis that is spaced radially from the axis of rotation such that an orientation of the magnet relative to the pivot axis varies as the magnet pivots about the pivot axis. A magnetic sensor is positioned to sense a magnetic field of the magnet at a point in a rotational path of the magnet around the axis of rotation and is configured to measure an orientation of the magnetic field of the magnet at the point in the rotational path of the magnet. Processing circuitry in communication with the magnetic sensor is configured to determine an estimate of an amount of toner in the reservoir correlating with the measured orientation of the magnetic field of the magnet at the point in the rotational path of the magnet.

A toner level detection assembly for an electrophotographic image forming device according to another example embodiment includes a reservoir for storing toner. A rotatable shaft is positioned within the reservoir and has an axis of rotation. A magnet is connected to the rotatable shaft and is rotatable with the rotatable shaft around the axis of rotation. The magnet is pivotable independent of the rotatable shaft about a pivot axis that is spaced radially from the axis of rotation such that an orientation of the magnet relative to the pivot axis varies as the magnet pivots about the pivot axis. A magnetic sensor is positioned to sense a magnetic field of the magnet at a point in a rotational path of the magnet around the axis of rotation and is configured to measure a magnitude of each three-dimensional magnetic field component of the magnetic field of the magnet at the point in the rotational path of the magnet. Processing circuitry in communication with the magnetic sensor is configured to determine an angle of the magnet at the point in the rotational path of the magnet based on the measured magnitudes of the three-dimensional magnetic field components of the magnetic field of the magnet at the point in the rotational path of the magnet and is configured to determine an estimate of an amount of toner in the reservoir correlating with the determined angle of the magnet at the point in the rotational path of the magnet.

A method for estimating an amount of toner in a reservoir of an electrophotographic image forming device according to one example embodiment includes rotating a shaft positioned in the reservoir. By rotating the shaft, a magnet that is pivotable independent of the shaft about a pivot axis that is spaced radially from an axis of rotation of the shaft rotates around the axis of rotation of the shaft. The magnet is positioned at the pivot axis. A magnetic field of the magnet at a point in a rotational path of the magnet around the axis of rotation is detected. An orientation of the magnetic field of the magnet at the point in the rotational path of the magnet is determined. An angle of the magnet at the point in the rotational path of the magnet is determined based on the determined orientation of the magnetic field of the magnet at the point in the rotational path of the magnet. The amount of toner in the reservoir is estimated based on a predetermined correlation with the determined angle of the magnet at the point in the rotational path of the magnet.

BRIEF DESCRIPTION OF THE DRAWINGS

The accompanying drawings incorporated in and forming a part of the specification illustrate several aspects of the present disclosure and together with the description serve to explain the principles of the present disclosure.

DETAILED DESCRIPTION

In the following description, reference is made to the accompanying drawings where like numerals represent like elements. The embodiments are described in sufficient detail to enable those skilled in the art to practice the present disclosure. It is to be understood that other embodiments may be utilized and that process, electrical, and mechanical changes, etc., may be made without departing from the scope of the present disclosure. Examples merely typify possible variations. Portions and features of some embodiments may be included in or substituted for those of others. The following description, therefore, is not to be taken in a limiting sense and the scope of the present disclosure is defined only by the appended claims and their equivalents.

Figure 1:
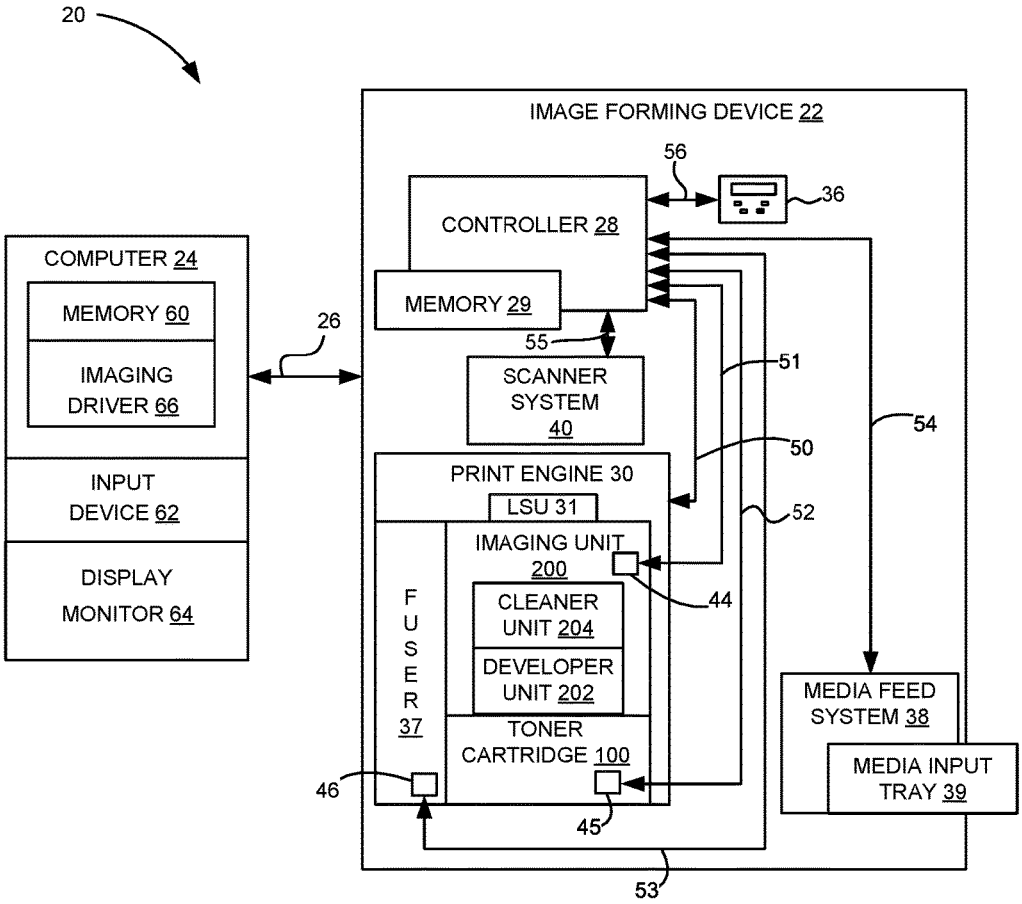
FIG. 1 is a block diagram of an imaging system according to one example embodiment.

Referring now to the drawings and particularly to FIG. 1, there is shown a block diagram depiction of an imaging system 20 according to one example embodiment. Imaging system 20 includes an image forming device 22 and a computer 24. Image forming device 22 communicates with computer 24 via a communications link 26. As used herein, the term "communications link" generally refers to any structure that facilitates electronic communication between multiple components and may operate using wired or wireless technology and may include communications over the Internet.

In the example embodiment shown in FIG. 1, image forming device 22 is a multifunction machine (sometimes referred to as an all-in-one (AIO) device) that includes a controller 28, a print engine 30, a laser scan unit (LSU) 31, an imaging unit 200, a toner cartridge 100, a user interface 36, a media feed system 38, a media input tray 39 and a scanner system 40. Image forming device 22 may communicate with computer 24 via a standard communication protocol, such as, for example, universal serial bus (USB), Ethernet or IEEE 802.xx. Image forming device 22 may be, for example, an electrophotographic printer/copier including an integrated scanner system 40 or a standalone electrophotographic printer.

Controller 28 includes a processor unit and associated electronic memory 29. The processor may include one or more integrated circuits in the form of a microprocessor or central processing unit and may be formed as one or more Application-Specific Integrated Circuits (ASICs). Memory 29 may be any volatile or non-volatile memory or combination thereof, such as, for example, random access memory (RAM), read only memory (ROM), flash memory and/or non-volatile RAM (NVRAM). Memory 29 may be in the form of a separate memory (e.g., RAM, ROM, and/or NVRAM), a hard drive, a CD or DVD drive, or any memory device convenient for use with controller 28. Controller 28 may be, for example, a combined printer and scanner controller.

In the example embodiment illustrated, controller 28 communicates with print engine 30 via a communications link 50. Controller 28 communicates with imaging unit 200 and processing circuitry 44 thereon via a communications link 51. Controller 28 communicates with toner cartridge 100 and processing circuitry 45 thereon via a communications link 52. Controller 28 communicates with a fuser 37 and processing circuitry 46 thereon via a communications link 53. Controller 28 communicates with media feed system 38 via a communications link 54. Controller 28 communicates with scanner system 40 via a communications link 55. User interface 36 is communicatively coupled to controller 28 via a communications link 56. Controller 28 processes print and scan data and operates print engine 30 during printing and scanner system 40 during scanning. Processing circuitry 44, 45, 46 may provide authentication functions, safety and operational interlocks, operating parameters and usage information related to imaging unit 200, toner cartridge 100 and fuser 37, respectively. Each of processing circuitry 44, 45, 46 includes a processor unit and associated electronic memory. As discussed above, the processor may include one or more integrated circuits in the form of a microprocessor or central processing unit and may be formed as one or more Application-specific integrated circuits (ASICs). The memory may be any volatile or non-volatile memory or combination thereof or any memory device convenient for use with processing circuitry 44, 45, 46.

Computer 24, which is optional, may be, for example, a personal computer, including electronic memory 60, such as RAM, ROM, and/or NVRAM, an input device 62, such as a keyboard and/or a mouse, and a display monitor 64. Computer 24 also includes a processor, input/output (I/O) interfaces, and may include at least one mass data storage device, such as a hard drive, a CD-ROM and/or a DVD unit (not shown). Computer 24 may also be a device capable of communicating with image forming device 22 other than a personal computer such as, for example, a tablet computer, a smartphone, or other electronic device.

In the example embodiment illustrated, computer 24 includes in its memory a software program including program instructions that function as an imaging driver 66, e.g., printer/scanner driver software, for image forming device 22. Imaging driver 66 is in communication with controller 28 of image forming device 22 via communications link 26. Imaging driver 66 facilitates communication between image forming device 22 and computer 24. One aspect of imaging driver 66 may be, for example, to provide formatted print data to image forming device 22, and more particularly to print engine 30, to print an image. Another aspect of imaging driver 66 may be, for example, to facilitate collection of scanned data from scanner system 40.

In some circumstances, it may be desirable to operate image forming device 22 in a standalone mode. In the standalone mode, image forming device 22 is capable of functioning without computer 24. Accordingly, all or a portion of imaging driver 66, or a similar driver, may be located in controller 28 of image forming device 22 so as to accommodate printing and/or scanning functionality when operating in the standalone mode.

Print engine 30 includes a laser scan unit (LSU) 31, toner cartridge 100, imaging unit 200 and fuser 37, all mounted within image forming device 22. Imaging unit 200 is removably mounted in image forming device 22 and includes a developer unit 202 that houses a toner sump and a toner development system. In one embodiment, the toner development system utilizes what is commonly referred to as a single component development system. In this embodiment, the toner development system includes a toner adder roll that provides toner from the toner sump to a developer roll. A doctor blade provides a metered, uniform layer of toner on the surface of the developer roll. In another embodiment, the toner development system utilizes what is commonly referred to as a dual component development system. In this embodiment, toner in the toner sump of developer unit 202 is mixed with magnetic carrier beads. The magnetic carrier beads may be coated with a polymeric film to provide triboelectric properties to attract toner to the carrier beads as the toner and the magnetic carrier beads are mixed in the toner sump. In this embodiment, developer unit 202 includes a magnetic roll that attracts the magnetic carrier beads having toner thereon to the magnetic roll through the use of magnetic fields. Imaging unit 200 also includes a cleaner unit 204 that houses a photoconductive drum and a waste toner removal system.

Toner cartridge 100 is removably mounted in imaging forming device 22 in a mating relationship with developer unit 202 of imaging unit 200. An outlet port on toner cartridge 100 communicates with an inlet port on developer unit 202 allowing toner to be periodically transferred from toner cartridge 100 to resupply the toner sump in developer unit 202.

The electrophotographic printing process is well known in the art and, therefore, is described briefly herein. During a printing operation, laser scan unit 31 creates a latent image on the photoconductive drum in cleaner unit 204. Toner is transferred from the toner sump in developer unit 202 to the latent image on the photoconductive drum by the developer roll (in the case of a single component development system) or by the magnetic roll (in the case of a dual component development system) to create a toned image. The toned image is then transferred to a media sheet received by imaging unit 200 from media input tray 39 for printing. Toner may be transferred directly to the media sheet by the photoconductive drum or by an intermediate transfer member that receives the toner from the photoconductive drum. Toner remnants are removed from the photoconductive drum by the waste toner removal system. The toner image is bonded to the media sheet in fuser 37 and then sent to an output location or to one or more finishing options such as a duplexer, a stapler or a hole-punch.

Figure 2:
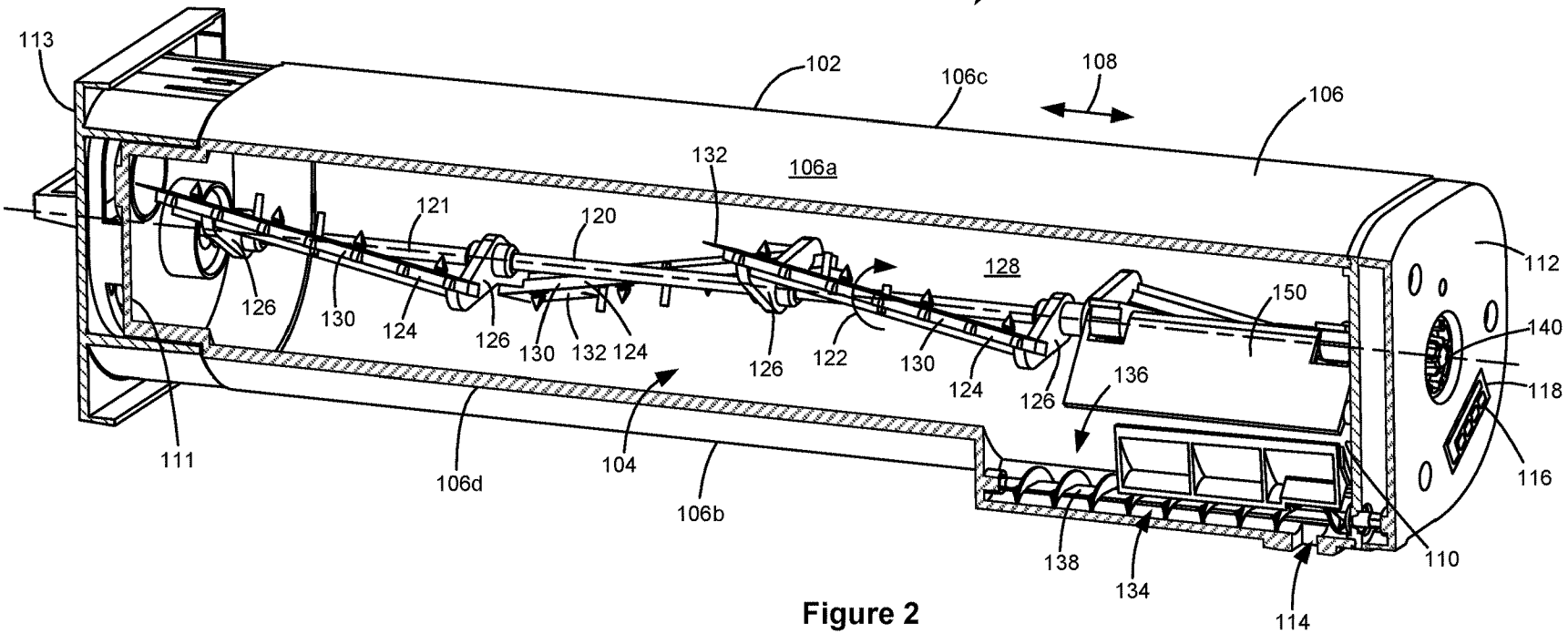
FIG. 2 is a perspective view of a toner cartridge of the imaging system having a portion of a wall omitted in order to illustrate a sense paddle mounted on a rotatable shaft according to one example embodiment.

Referring now to FIG. 2, a toner cartridge 100 is shown according to one example embodiment. Toner cartridge 100 includes an elongated housing 102 that includes walls forming a toner reservoir 104. In the example embodiment illustrated, housing 102 includes a generally cylindrical wall 106 that extends along a longitudinal dimension 108 of housing 102 and a pair of end walls 110, 111. Wall 106 includes a top 106*a*, a bottom 106*b* and sides 106*c*, 106*d*. In the embodiment illustrated, end caps 112, 113 are mounted on end walls 110, 111, respectively, such as by suitable fasteners (e.g., screws, rivets, etc.) or by a snap-fit engagement. An outlet port 114 is positioned on bottom 106*b* of housing 102 near end wall 110. Toner is periodically delivered from reservoir 104 through outlet port 114 to an inlet port of imaging unit 200 to refill a reservoir of imaging unit 200 as toner is consumed by the printing process. As desired, outlet port 114 may include a shutter or cover that is movable between a closed position blocking outlet port 114 to prevent toner from flowing out of toner cartridge 100 and an open position permitting toner flow.

Toner cartridge 100 includes one or more electrical contacts 116 positioned on the outer surface of housing 102, e.g., on end wall 110. In one embodiment, electrical contacts 116 are positioned on a printed circuit board 118 that also includes processing circuitry 45. Electrical contacts 116 are positioned to contact corresponding electrical contacts in image forming device 22 when toner cartridge 100 is installed in image forming device 22 in order to facilitate communications link 52 between processing circuitry 45 and controller 28.

FIG. 2 shows toner cartridge 100 with a portion of wall 106 omitted in order to illustrate internal components of toner cartridge 100. A rotatable shaft 120 extends along the length of toner cartridge 100 within toner reservoir 104. As desired, the ends of rotatable shaft 120 may be received in bushings or bearings positioned on an inner surface of end walls 110, 111. Shaft 120 is rotatable about a rotational axis 121. In operation, shaft 120 rotates in an operative rotational direction 122. Toner agitators, such as toner paddles 124, extend from and rotate with shaft 120 to stir and move toner within reservoir 104. In one embodiment, each paddle 124 includes a pair of arms 126 that extend away from shaft 120 toward an interior surface 128 of housing 102 that forms reservoir 104. A crossbeam 130 is positioned between distal ends of each pair of arms 126 near interior surface 128. In the example embodiment illustrated, a wiper 132 is mounted on an outer radial end of each crossbeam 130. Wipers 132 are formed from a flexible material such as a polyethylene terephthalate (PET) material, e.g., MYLAR@ available from DuPont Teijin Films, Chester, Va., USA. In one embodiment, wipers 132 form an interference fit with the interior surfaces 128 of top 106*a*, bottom 106*b* and sides 106*c*, 106*d* in order to wipe toner from the interior surfaces 128 as shaft 120 rotates. In one embodiment, adjacent paddles 124 alternate by 180 degrees along the length of shaft 120. This arrangement of paddles 124 keeps the torque on shaft 120 more uniform in comparison with paddles 124 all extending in the same radial direction.

In the example embodiment illustrated, a channel 134 runs along the longitudinal dimension 108 of housing 102 at the bottom 106*b* of housing 102. Channel 134 includes an inlet 136 that is open at one end of channel 134 to reservoir 104 to receive toner from reservoir 104. Channel 134 is open at its opposite end to outlet port 114 for exiting toner from channel 134. A rotatable auger 138 is positioned in channel 134 for moving toner received at inlet 136 to outlet port 114. In this embodiment, as shaft 120 rotates, paddles 124 direct toner in reservoir 104 toward inlet 136 of channel 134 to help move toner from reservoir 104 to outlet port 114.

A drive coupler 140 is exposed on an outer portion of housing 102 in position to receive rotational force from a corresponding drive system in image forming device 22 when toner cartridge 100 is installed in image forming device 22. In the example embodiment illustrated, drive coupler 140 is positioned on an outer surface of end wall 110; however, drive coupler 140 may be positioned elsewhere on housing 102 as desired. In one embodiment, drive coupler 140 is operatively connected (either directly or indirectly through one or more intermediate gears) to shaft 120 and auger 138 to rotate shaft 120 and auger 138 upon receiving rotational force from the corresponding drive system in image forming device 22.

The drive system in image forming device 22 includes a drive motor and a drive transmission from the drive motor to a drive coupler that mates with drive coupler 140 of toner cartridge 100 when toner cartridge 100 is installed in image forming device 22. The drive system in image forming device 22 may include an encoded device, such as an encoder wheel, (e.g., coupled to a shaft of the drive motor) and an associated code reader, such as an infrared sensor, to sense the motion of the encoded device. The code reader is in communication with controller 28 in order to permit controller 28 to track the amount of rotation of drive coupler 140, shaft 120 and auger 138.

With reference to FIGS. 2 and 3A-3C, toner cartridge 100 includes a sense paddle 150 mounted on shaft 120 that allows a sensor to detect the amount of toner present in reservoir 104 as discussed in greater detail below. Sense paddle 150 is freely pivotable independent of shaft 120 about a pivot axis 151 between a forward stop 152 and a rearward stop 154. In some embodiments, pivot axis 151 of sense paddle 150 is spaced radially from rotational axis 121 of shaft 120 and may be parallel to rotational axis 121 of shaft 120. In the example embodiment illustrated, sense paddle 150 is pivotally mounted to a pair of arms 156 that extend from and that are fixed to rotate with shaft 120. However, sense paddle 150 may be pivotally mounted to shaft 120 by any suitable construction. In the example embodiment illustrated, pivot axis 151 is fixed relative to rotational axis 121. In other embodiments, the position of pivot axis 151 relative to rotational axis 121 may vary, such as where sense paddle 150 flexes relative to shaft 120. In the example embodiment illustrated, sense paddle 150 includes a planar leading face 158 so that contact between toner in reservoir 104 and leading face 158 of sense paddle 150 impedes the motion of sense paddle 150 in operative rotational direction 122 to permit toner level sensing as discussed in greater detail below.

Figure 3A:
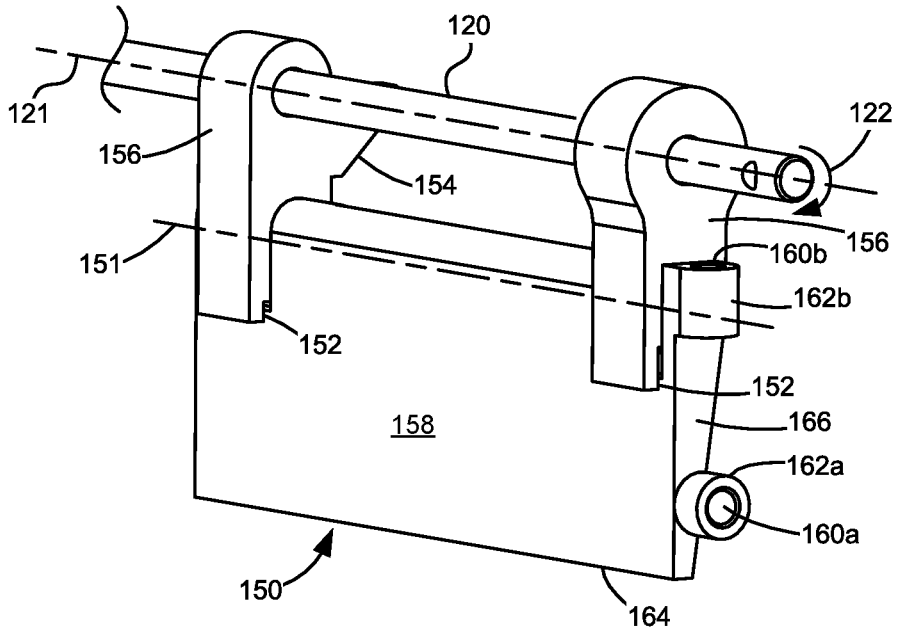
FIGS. 3A-3C are perspective views of the sense paddle mounted on the rotatable shaft according to one example embodiment.
Figure 3B:
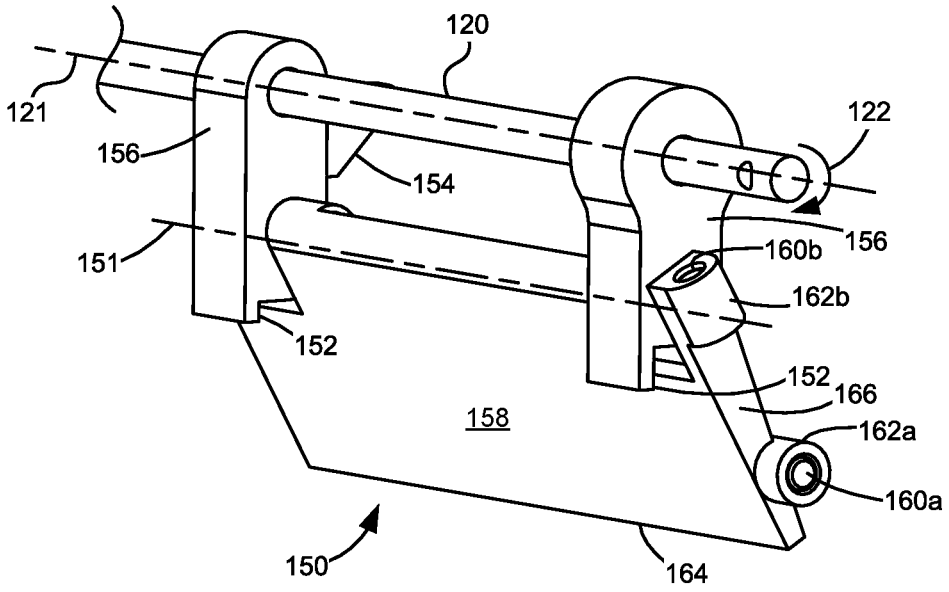
Figure 3C:
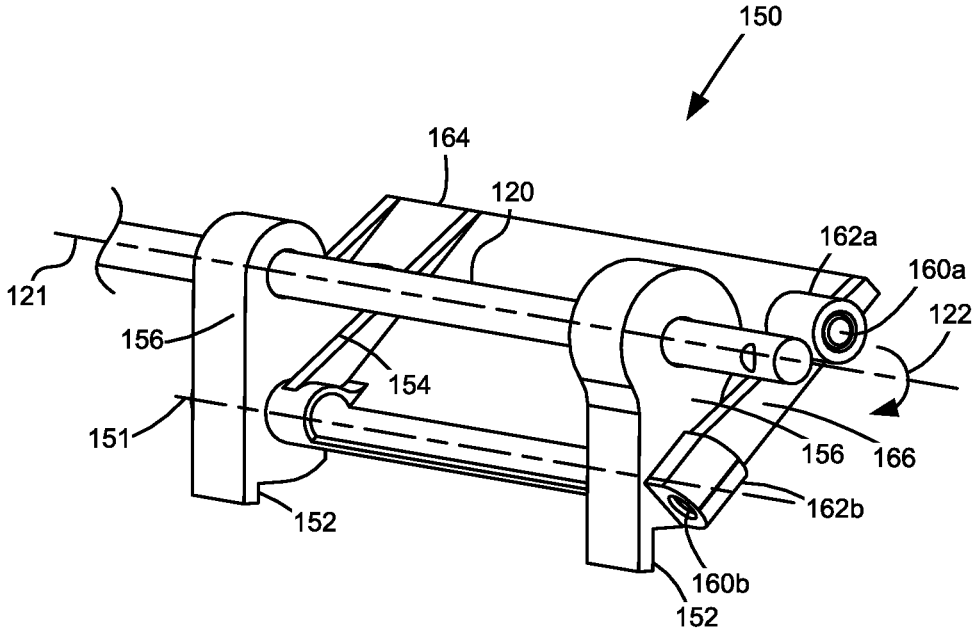

In the example embodiment illustrated, a forward stop 152 and a rearward stop 154 are positioned on each arm 156. Each stop 152, 154 may be formed as a rib, protrusion, ledge or other engagement surface on a respective arm 156 that is positioned in the pivot path of sense paddle 150 in order to limit the travel of sense paddle 150 relative to shaft 120. FIG. 3A shows sense paddle 150 positioned against forward stops 152. In the example embodiment illustrated, when sense paddle 150 is positioned against forward stops 152, sense paddle 150 (and, in particular, leading face 158 of sense paddle 150) extends in a radial orientation relative to rotational axis 121. FIG. 3B shows sense paddle 150 positioned between its forward and rearward stops 152, 154 with sense paddle 150 pivoted about pivot axis 151 counter to operative rotational direction 122 of shaft 120 relative to the position of sense paddle 150 shown in FIG. 3A. FIG. 3C shows sense paddle 150 positioned against rearward stops 154 with sense paddle 150 pivoted about pivot axis 151 counter to operative rotational direction 122 of shaft 120 relative to the position of sense paddle 150 shown in FIG. 3B. In the example embodiment illustrated, when sense paddle 150 is positioned against rearward stops 154, sense paddle 150 (and, in particular, leading face 158 of sense paddle 150) is positioned 135 degrees counter to operative rotational direction 122 of shaft 120 from the position of sense paddle 150 at its forward stops 152. However, the spacing between forward stops 152 and rearward stops 154 may be adjusted in order to achieve a desired motion of sense paddle 150.

As shown in FIG. 2, in the example embodiment illustrated, sense paddle 150 is positioned next to end wall 110, near outlet port 114 such that sense paddle 150 passes inlet 136 to channel 134 as shaft 120 rotates. In this manner, sense paddle 150 is positioned in the portion of reservoir 104 where toner tends to concentrate due to the motion of paddles 124 in order to improve the accuracy of the toner level data provided by the motion of sense paddle 150 as discussed in greater detail below.

One or more permanent magnets are connected to sense paddle 150 and detectable by a magnetic sensor as discussed in greater detail below. In the example embodiment illustrated, a pair of permanent magnets 160*a*, 160*b* are mounted on sense paddle 150. However, as discussed in greater detail below, in some embodiments, only one magnet may be used depending on the toner level sensing configuration employed. In the example embodiment illustrated, magnets 160*a*, 160*b* are mounted by a friction fit in respective cavities of mounts 162*a*, 162*b* positioned on sense paddle 150. However, magnets 160*a*, 160*b* may be connected to sense paddle 150 by any suitable configuration, for example, using an adhesive or fastener. Magnets 160*a*, 160*b* may be any suitable size and shape so as to be detectable by a magnetic sensor. Magnets 160*a*, 160*b* may be composed of any suitable permanent magnet material such as a bonded ferrite magnet, a ceramic ferrite magnet, an Alnico magnet, a neodymium magnet, a samarium cobalt magnet, etc. Magnets 160*a*, 160*b* are positioned in close proximity to but do not contact interior surface 128 of housing 102. In this manner, magnets 160*a*, 160*b* are positioned in close proximity to interior surface 128 of housing 102, but interior surface 128 of housing 102 does not impede the motion of sense paddle 150. In the example embodiment illustrated, magnet 160*a* is positioned near a distal end 164 of sense paddle 150 relative to pivot axis 151, at an axial end portion 166 of sense paddle 150 proximate to end wall 110 of housing 102. In the example embodiment illustrated, magnet 160*b* is positioned at pivot axis 151 of sense paddle 150, at axial end portion 166 of sense paddle 150 proximate to end wall 110 of housing 102.

Figure 4:
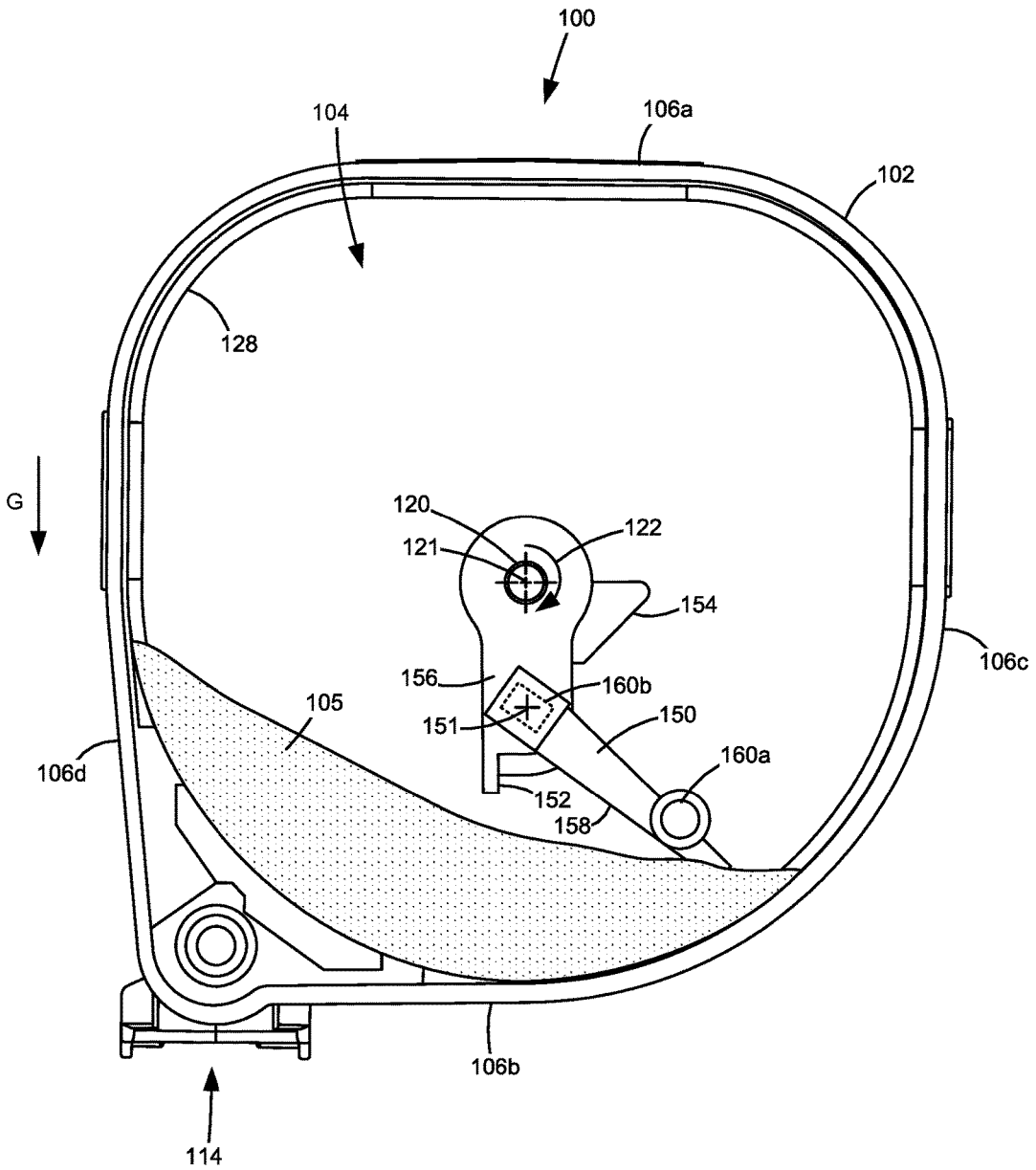
FIG. 4 is a cross-sectional view of the toner cartridge illustrating the sense paddle dragging across a top surface of toner in the toner cartridge according to one example embodiment.

With reference to FIG. 4, in operation, as shaft 120 rotates in operative rotational direction 122, the motion of sense paddle 150 is affected by the amount of toner 105 present in reservoir 104. In general, resistance from toner 105 in reservoir 104 against leading face 158 of sense paddle 150 tends to impede the motion of sense paddle 150 in operative rotational direction 122 and push sense paddle 150 away from forward stop 152 and toward rearward stop 154. Absent resistance from toner 105, sense paddle 150 tends to freely pivot about pivot axis 151 between forward stop 152 and rearward stop 154 due to gravity (indicated by the arrow G) as shaft 120 rotates. When the toner level in reservoir 104 is low (e.g., less than half full), sense paddle 150 tends to drag across the top surface of toner 105 in reservoir 104 as depicted in FIG. 4. That is, when the toner level in reservoir 104 is low, as sense paddle 150 advances from a vertically upward position (12:00 position) toward a vertically downward position (6:00 position) due to rotation of shaft 120 in operative rotational direction 122, leading face 158 of sense paddle 150 contacts the toner 105 in reservoir 104. The resistance from toner 105 causes sense paddle 150 to pivot about pivot axis 151 counter to operative rotational direction 122, toward rearward stop 154 causing sense paddle 150 to drag across the surface of toner 105 as shaft 120 continues to rotate in operative rotational direction 122. In this manner, the motion of sense paddle 150 relative to shaft 120 varies as arms 156 travel through the bottom portion of reservoir 104 depending on the amount of toner 105 present in reservoir 104. As a result, the motion of magnets 160*a*, 160*b* also varies depending on the amount of toner 105 present in reservoir 104 permitting estimation of the toner level in reservoir 104 by detecting the motion of magnet 160*a* and/or 160*b* as shaft 120 rotates.

Figure 5A:
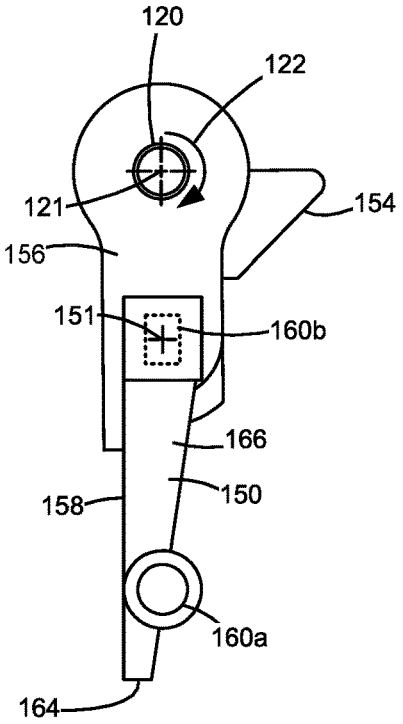
FIGS. 5A-5E are sequential side elevation views of the sense paddle according to one example embodiment.
Figure 5B:
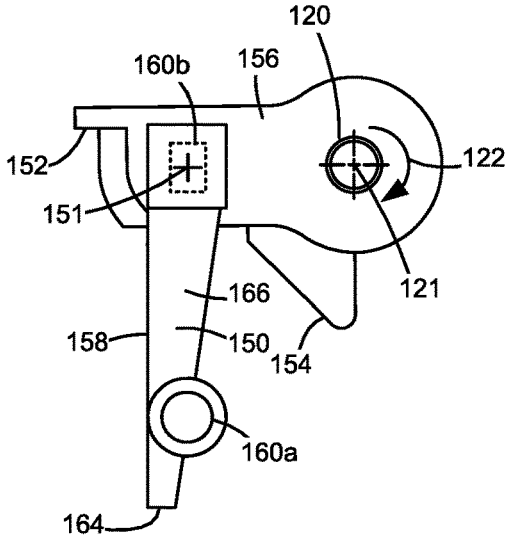
Figure 5C:
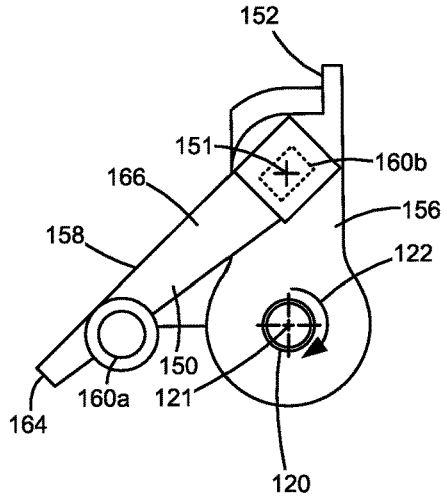
Figure 5D:
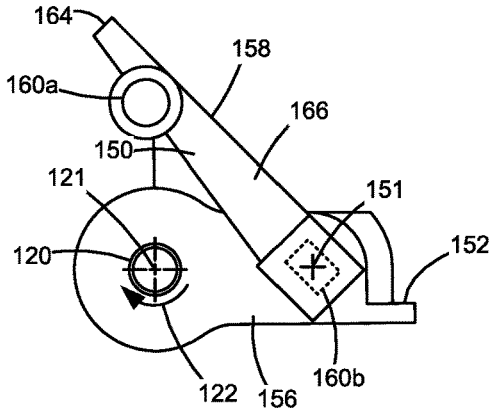
Figure 5E:
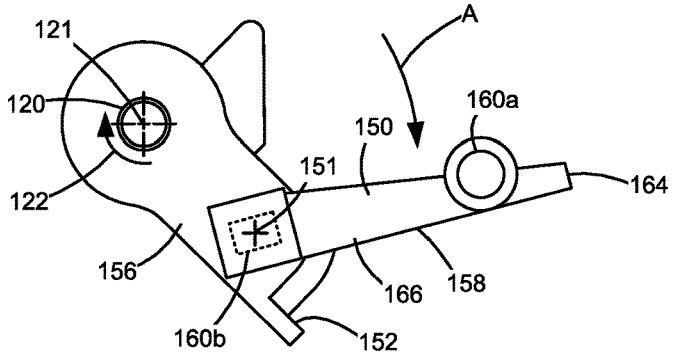

FIGS. 5A-5E sequentially illustrate the position of sense paddle 150 relative to shaft 120 and arms 156 at various rotational positions of shaft 120 when sense paddle 150 is not subject to resistance from toner (e.g., when no toner is present in reservoir 104). FIG. 5A shows the position of sense paddle 150 when arms 156 are in a vertically downward position (6:00 position). When arms 156 are in a vertically downward position, absent resistance from toner, sense paddle 150 tends to hang downward due to gravity. FIG. 5B shows shaft 120 rotated ninety degrees in operative rotational direction 122 relative to FIG. 5A with arms 156 in a horizontal position (9:00 position). As shaft 120 rotates from the orientation shown in FIG. 5A to the orientation shown in Figure SB, sense paddle 150 continues to hang downward between forward stop 152 and rearward stop 154 due to gravity. FIG. 5C shows shaft 120 rotated ninety degrees in operative rotational direction 122 relative to FIG. 5B with arms 156 in a vertically upward position (12:00 position). As shaft 120 rotates from the orientation shown in FIG. 5B to the orientation shown in FIG. 5C, sense paddle 150 continues to hang downward between forward stop 152 and rearward stop 154 until rearward stop 154 contacts sense paddle 150 and pushes sense paddle 150 in operative rotational direction 122. FIG. 5D shows shaft 120 rotated ninety degrees in operative rotational direction 122 relative to FIG. 5C with arms 156 in a horizontal position (3:00 position). As shaft 120 rotates from the orientation shown in FIG. 5C, rearward stop 154 continues to push sense paddle 150 in operative rotational direction 122. FIG. 5E shows shaft 120 rotated forty-five degrees in operative rotational direction 122 relative to FIG. 5D with arms 156 between the horizontal position and the vertically downward position (between the 4:00 position and the 5:00 position). As indicated by the arrow A in Figure SE, after the center of gravity of sense paddle 150 passes the vertically upward position, absent resistance from toner, sense paddle 150 falls forward in operative rotational direction 122 due to gravity until sense paddle 150 contacts forward stop 152. As shaft 120 continues to rotate back to the orientation shown in FIG. 5A, absent resistance from toner, sense paddle 150 continues to rest on forward stop 152 until sense paddle 150 passes the vertically downward position at which point sense paddle 150 tends to hang downward as discussed above.

Figure 6:
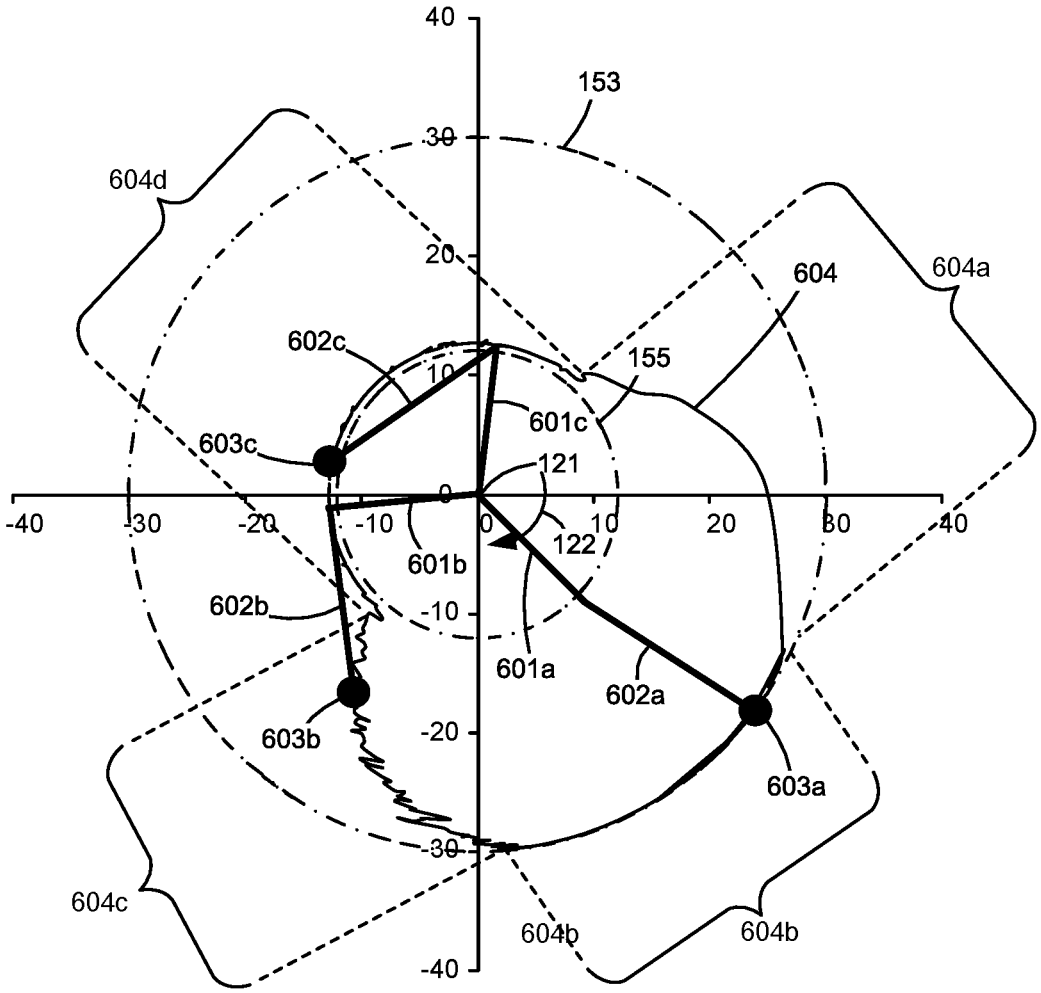
FIG. 6 is a graph depicting the motion of the sense paddle when no toner is present in the toner cartridge according to one example embodiment.

FIG. 6 is a graph illustrating the motion of sense paddle 150 when sense paddle 150 is not subject to resistance from toner (e.g., when no toner is present in reservoir 104). Lines 601*a*, 601*b*, 601*c* in FIG. 6 represent various positions of arms 156 as shaft 120 rotates and lines 602*a*, 602*b*, 602*c* represent corresponding positions of sense paddle 150 when sense paddle 150 is not subject to resistance from toner. Points 603*a*, 603*b*, 603*c* represent the positions of magnet 160*a* on sense paddle 150 at each of the positions of sense paddle 150 illustrated. FIG. 6 also depicts a maximum radius 153 of magnet 160*a* relative to rotational axis 121 of shaft 120, when sense paddle 150 is at forward stop 152, and a minimum radius 155 of magnet 160*a* relative to rotational axis 121 of shaft 120, when sense paddle 150 is at rearward stop 154, in millimeters according to one example embodiment. Line 604 represents the radial positions of magnet 160*a* relative to rotational axis 121 of shaft 120 for one complete revolution of shaft 120 when sense paddle 150 is not subject to resistance from toner.

As illustrated in FIG. 6, the actual motion of magnet 160*a* in operation is between the maximum and minimum radii 153, 155 of magnet 160*a*. Region 604*a* of line 604 shows where sense paddle 150 falls forward ahead of rearward stop 154 as sense paddle 150 passes the vertically upward position. Region 604*b* of line 604 shows where sense paddle 150 is positioned against forward stop 152 as sense paddle 150 and arms 156 advance toward the vertically downward position. Lines 601*a*, 602*a* and point 603*a* show example positions of arms 156, sense paddle 150 and magnet 160*a* in region 604*b* as sense paddle 150 and arms 156 advance toward the vertically downward position. Region 604*c* of line 604 shows where sense paddle 150 hangs downward between forward stop 152 and rearward stop 154 as arms 156 advance upward after passing the vertically downward position. Lines 601*b*, 602*b*, and point 603*b* show example positions of arms 156, sense paddle 150 and magnet 160*a* in region 604*c* as sense paddle 150 hangs downward and arms 156 advance upward after passing the vertically downward position. Region 604*d* of line 604 shows where sense paddle 150 is positioned against rearward stop 154 after rearward stop 154 contacts sense paddle 150 and pushes sense paddle 150 in operative rotational direction 122 as sense paddle 150 advances toward the vertically upward position. Lines 601*c*, 602*c* and point 603*c* show example positions of arms 156, sense paddle 150 and magnet 160*a* in region 604*d* as sense paddle 150 advances toward the vertically upward position.

Figure 7:
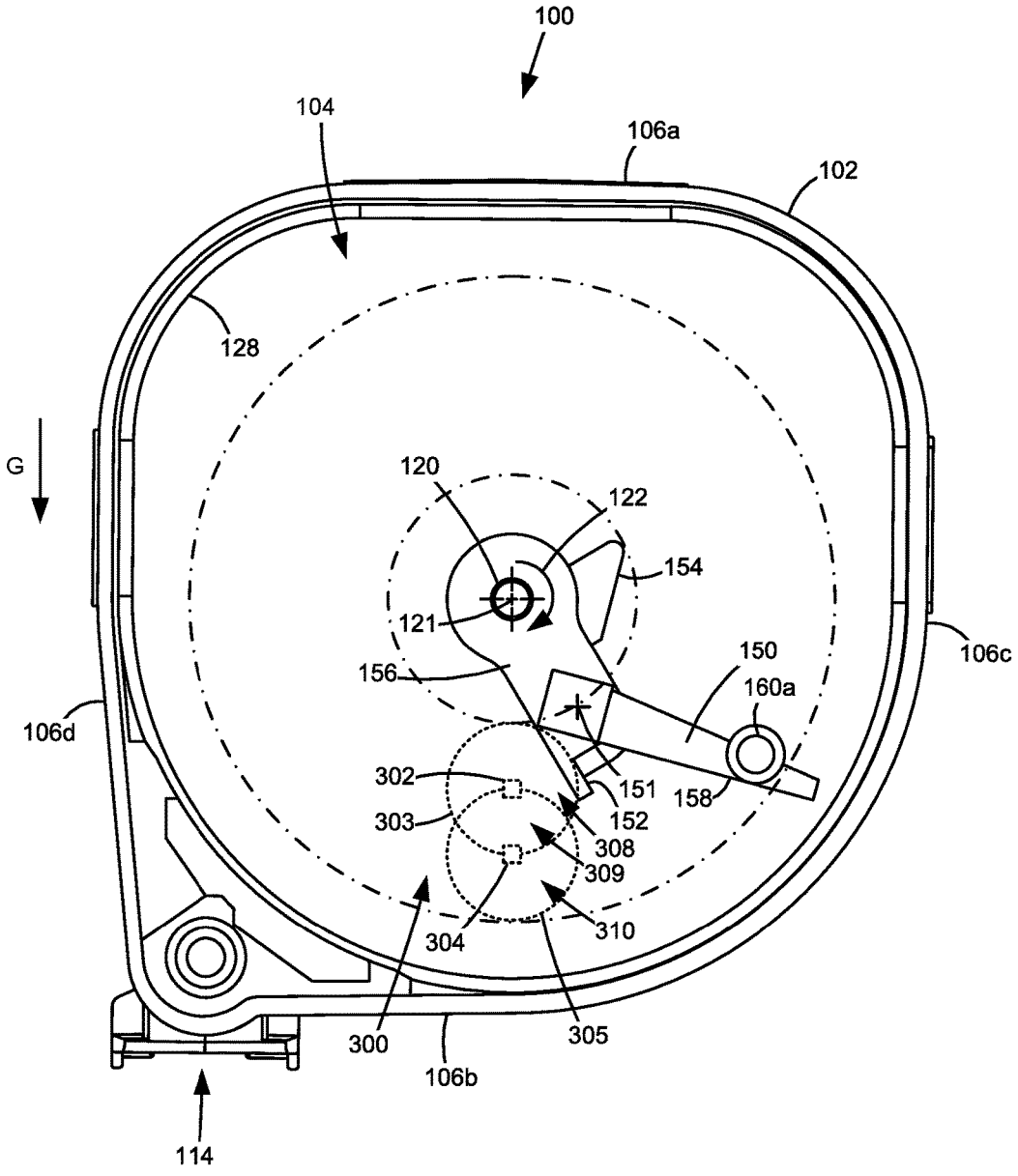
FIG. 7 is a cross-sectional view of the toner cartridge depicting a system for detecting an amount of toner remaining in the toner cartridge according to a first example embodiment.

FIG. 7 illustrates a system 300 for detecting the motion of magnet 160*a* of sense paddle 150 in order to estimate the amount of toner in reservoir 104 according to one example embodiment. System 300 utilizes only magnet 160*a* of sense paddle 150. Accordingly, magnet 160*b* may be omitted from system 300 as shown in FIG. 7. System 300 includes at least two magnetic sensors 302, 304 preferably positioned outside of reservoir 104. Magnetic sensors 302, 304 detect the radial position of magnet 160*a* relative to rotational axis 121 of shaft 120 as magnet 160*a* passes magnetic sensors 302, 304 in order to determine the amount of toner in reservoir 104. In one embodiment, magnetic sensors 302, 304 are mounted on housing 102 of toner cartridge 100. In this embodiment, magnetic sensors 302, 304 may be in communication with processing circuitry 45 of toner cartridge 100 so that information from magnetic sensors 302, 304 can be sent to controller 28 of image forming device 22. Alternatively, electrical contacts on the outer surface of housing 102, e.g., on printed circuit board 118, may contact corresponding electrical contacts in image forming device 22 when toner cartridge 100 is installed in image forming device 22 in order to facilitate communication between magnetic sensors 302, 304 and controller 28. In another embodiment, magnetic sensors 302, 304 are positioned on a portion of image forming device 22 adjacent to housing 102 when toner cartridge 100 is installed in image forming device 22. In this embodiment, magnetic sensors 302, 304 are in communication with controller 28. Magnetic sensors 302, 304 are positioned near or on the outer surface of housing 102 such that magnet 160*a* passes in close proximity to sensors 302, 304 as shaft 120 rotates. In the example embodiment illustrated, magnetic sensors 302, 304 are positioned adjacent to or on end wall 110 of housing 102.

Each magnetic sensor 302, 304 may be any suitable device capable of detecting the presence of a magnetic field. For example, each magnetic sensor 302, 304 may be a Hall-effect sensor, which is a transducer that varies its electrical output in response to a magnetic field. In some embodiments, each magnetic sensor 302, 304 is a Hall-effect sensor that includes an analog-to-digital converter that provides a digital output having a high or low signal when the strength of the magnetic field detected by the magnetic sensor 302, 304 meets or exceeds a threshold amount and an opposite low or high signal when the strength of the magnetic field detected by the magnetic sensor 302, 304 is less than the threshold amount. A single-axis or a multi-axis Hall effect sensor may be used as desired.

Magnetic sensors 302, 304 are positioned vertically lower than rotational axis 121 of shaft 120 with magnetic sensor 302 positioned vertically higher than magnetic sensor 304. In the embodiment illustrated, magnetic sensors 302, 304 are positioned along a vertically downward radius from rotational axis 121 of shaft 120 such that magnetic sensors 302, 304 detect the radial position of magnet 160*a* relative to rotational axis 121 as magnet 160*a* passes the vertically downward position. Each magnetic sensor 302, 304 possesses a sensing radius 303, 305 within which magnetic sensor 302, 304 is configured to detect the presence of a magnetic field. The sensing radius 303, 305 of each magnetic sensor 302, 304 depends on the sensitivity of the magnetic sensor 302, 304 and the strength of magnet 160*a*. In the example embodiment illustrated, a lower portion of sense radius 303 of magnetic sensor 302 overlaps with an upper portion of sense radius 305 of magnetic sensor 304. As a result, magnetic sensors 302, 304 provide three distinct sensing zones 308, 309, 310. Sensing zone 308 is positioned within sense radius 303 of magnetic sensor 302 but outside of sense radius 305 of magnetic sensor 304. Sensing zone 309 is provided in the overlap between sense radii 303 and 305. Sensing zone 310 is positioned within sense radius 305 of magnetic sensor 304 but outside of sense radius 303 of magnetic sensor 302. Alternatively, magnetic sensors 302, 304 may be positioned such that sense radii 303 and 305 do not overlap; however, overlapping sense radii 303 and 305 provides the benefit of a third sensing zone without requiring a third magnetic sensor. Additional embodiments may include three or more magnetic sensors arranged vertically in a similar overlapping arrangement between rotational axis 121 of shaft 120 and bottom 106*b* of housing 102 if more than three sensing zones are desired.

Figure 8A:
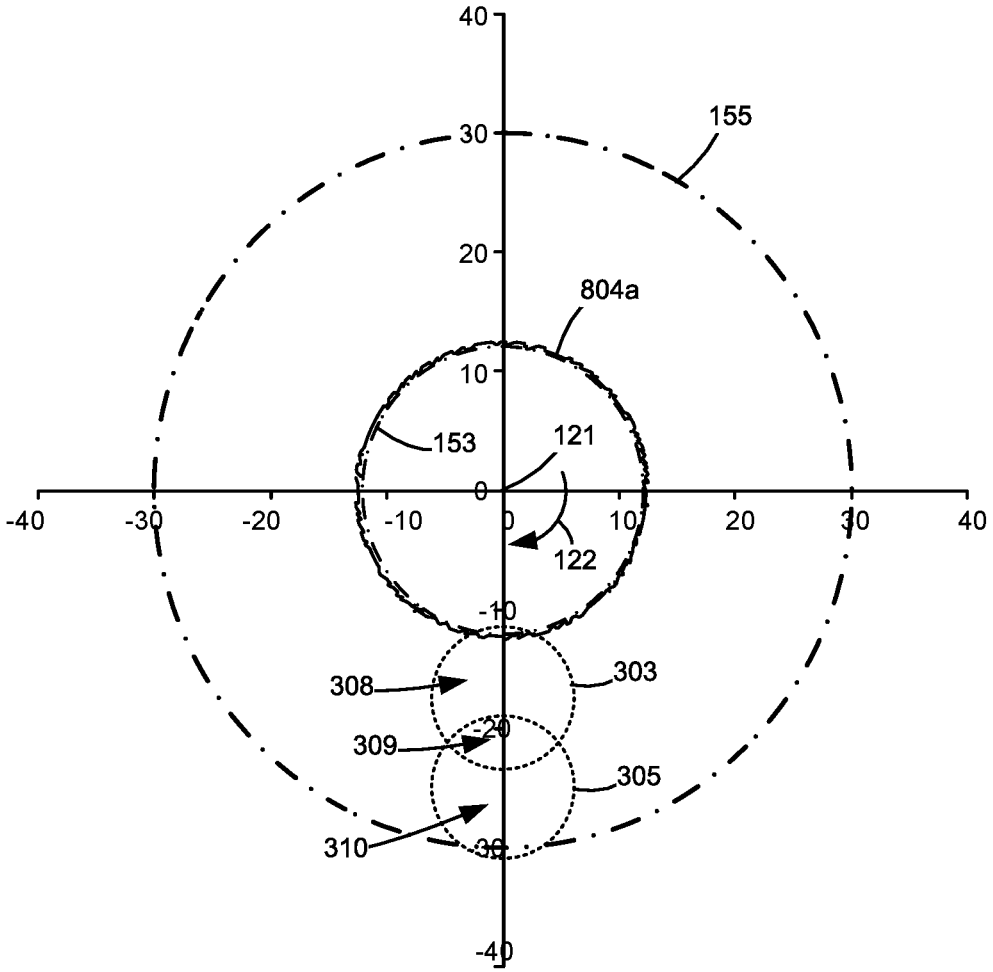
FIGS. 8A-8D are sequential graphs depicting the motion of the sense paddle as the toner level in the toner cartridge decreases according to one example embodiment.

FIGS. 8A-8D are sequential graphs illustrating changes in the motion of sense paddle 150 as the toner level in reservoir 104 decreases. FIG. 8A shows the motion of sense paddle 150 in a full toner reservoir 104, containing approximately 487 grams of toner in the example embodiment illustrated. Line 804*a* represents the radial positions of magnet 160*a* relative to rotational axis 121 of shaft 120 for one complete revolution of shaft 120. As shown in FIG. 8A, when toner reservoir 104 is full, resistance from the toner tends to keep sense paddle 150 pressed against rearward stop 154. As a result, line 804*a* closely tracks with minimum radius 155 of magnet 160*a*. In the example embodiment illustrated, when toner reservoir 104 is full, magnet 160*a* is detected in sensing zone 308 as shaft 120 rotates, i.e., magnetic sensor 302 detects magnet 160*a* within sense radius 303 but magnetic sensor 304 does not detect magnet 160*a* within sense radius 305.

Figure 8B:
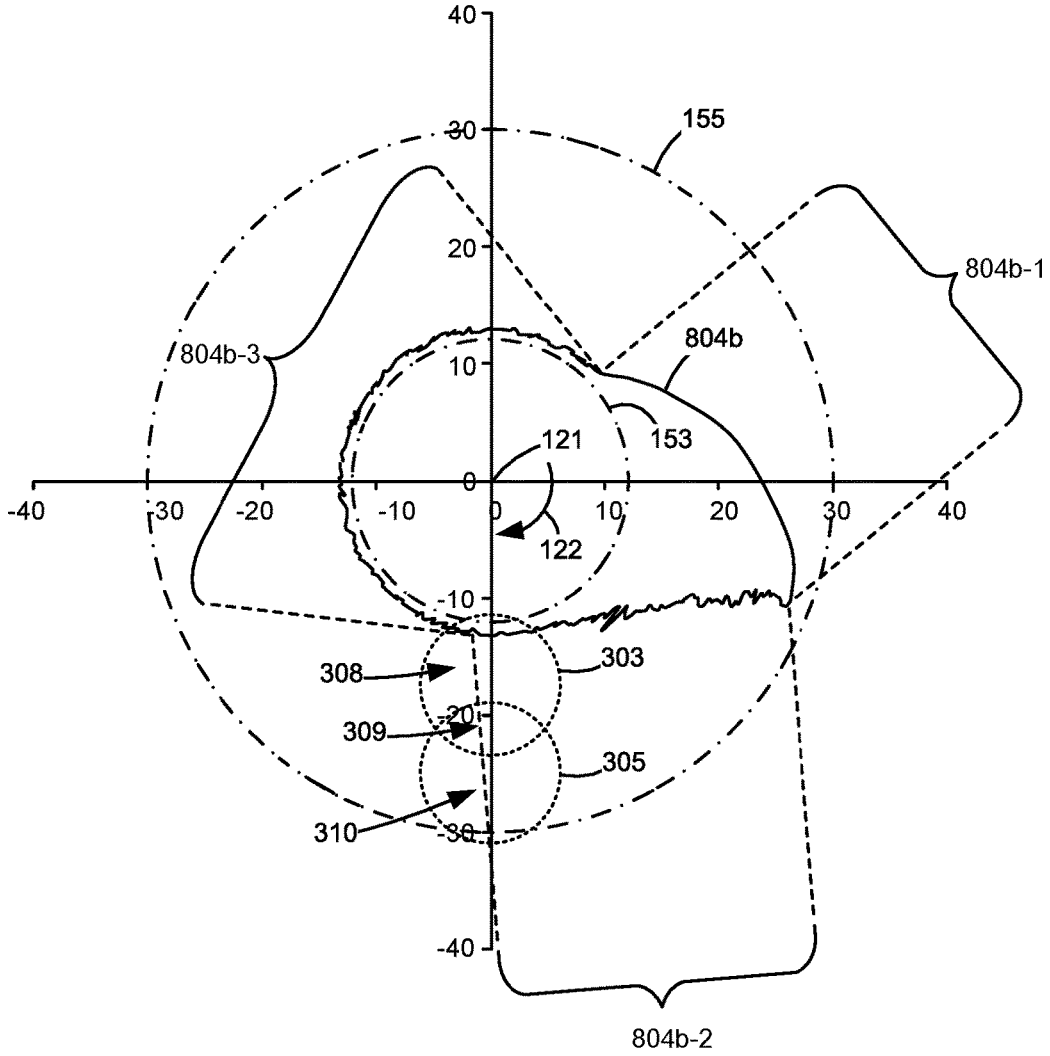

FIG. 8B shows the motion of sense paddle 150 in a roughly half-full toner reservoir 104, containing approximately 236 grams of toner in the example embodiment illustrated. Line 804*b* represents the radial positions of magnet 160*a* relative to rotational axis 121 of shaft 120 for one complete revolution of shaft 120. As shown in FIG. 8B, when toner reservoir 104 is half-full, after sense paddle 150 passes the vertically upward position, sense paddle 150 falls forward in operative rotational direction 122 (as represented by region 804*b*-1 of line 804*b* where the radius of magnet 160*a* is between maximum and minimum radii 153, 155) and lands on top of the toner in reservoir 104. Sense paddle 150 remains on top of the toner in reservoir 104 (as represented by region 804*b*-2 of line 804*b* where the radius of magnet 160*a* is between maximum and minimum radii 153, 155) until rearward stop 154 contacts sense paddle 150 and pushes sense paddle 150 through the toner and back up to the vertically upward position (as represented by region 804*b*-3 of line 804*b* where the radius of magnet 160*a* closely tracks with minimum radius 155). In the example embodiment illustrated, when toner reservoir 104 is half-full, magnet 160*a* is detected in sensing zone 308 as shaft 120 rotates, i.e., magnetic sensor 302 detects magnet 160*a* within sense radius 303 but magnetic sensor 304 does not detect magnet 160*a* within sense radius 305.

Figure 8C:
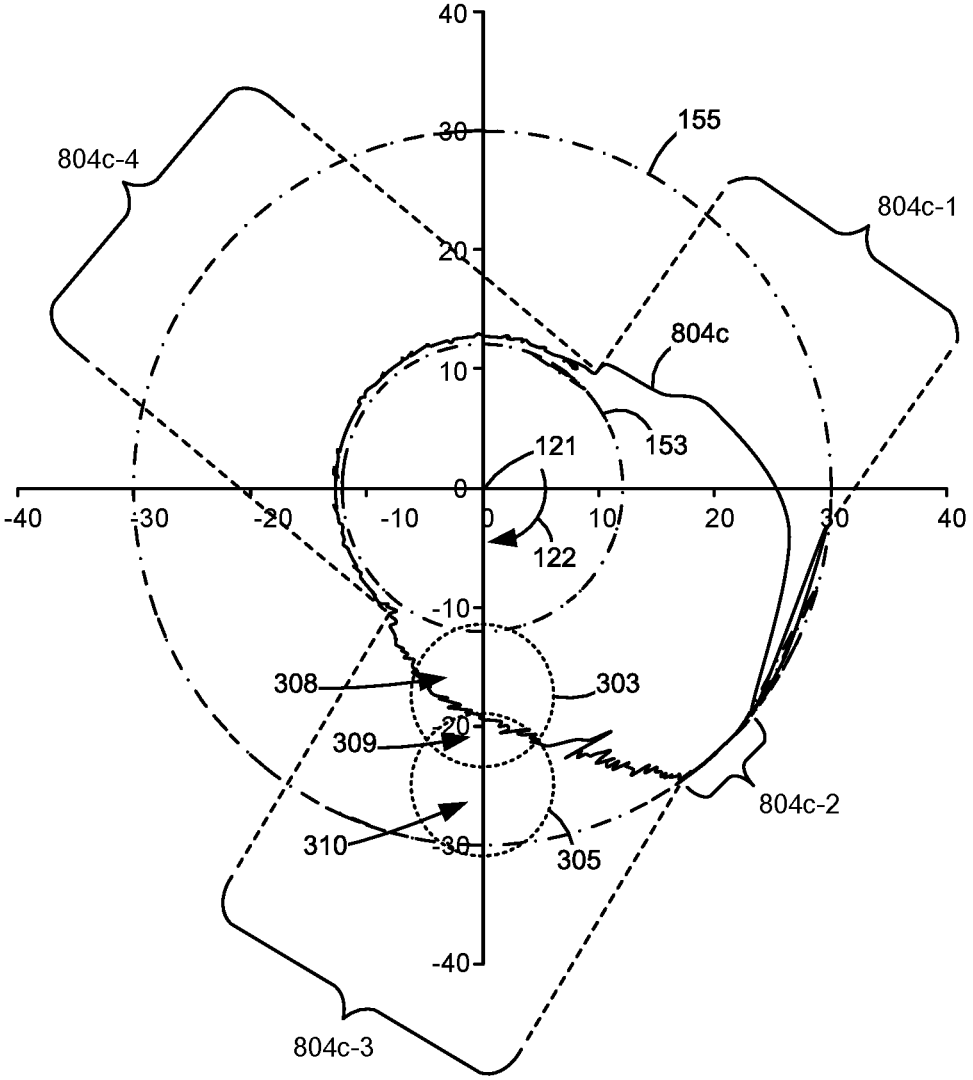

FIG. 8C shows the motion of sense paddle 150 when the toner level in toner reservoir 104 is low, containing approximately 62 grams of toner in the example embodiment illustrated. Line 804*c* represents the radial positions of magnet 160*a* relative to rotational axis 121 of shaft 120 for one complete revolution of shaft 120. As shown in FIG. 8C, when the toner level in toner reservoir 104 is low, after sense paddle 150 passes the vertically upward position, sense paddle 150 falls forward in operative rotational direction 122 (as represented by region 804*c*-1 of line 804*c* where the radius of magnet 160*a* is between maximum and minimum radii 153, 155) and reaches forward stop 152. Sense paddle 150 remains at forward stop 152 (as represented by region 804*c*-2 of line 804*c* where the radius of magnet 160*a* closely tracks with maximum radius 153) until leading face 158 of sense paddle 150 reaches the toner in reservoir 104. Sense paddle 150 remains on top of the toner in reservoir 104 (as represented by region 804*c*-3 of line 804*c* where the radius of magnet 160*a* is between maximum and minimum radii 153, 155) until rearward stop 154 contacts sense paddle 150 and pushes sense paddle 150 through the toner and back up to the vertically upward position (as represented by region 804*c*-4 of line 804*c* where the radius of magnet 160*a* closely tracks with minimum radius 155). In the example embodiment illustrated, when the toner level in toner reservoir 104 is low, magnet 160*a* is detected in sensing zone 309 as shaft 120 rotates, i.e., magnetic sensors 302, 304 both detect magnet 160*a* within sense radii 303, 305.

Figure 8D:
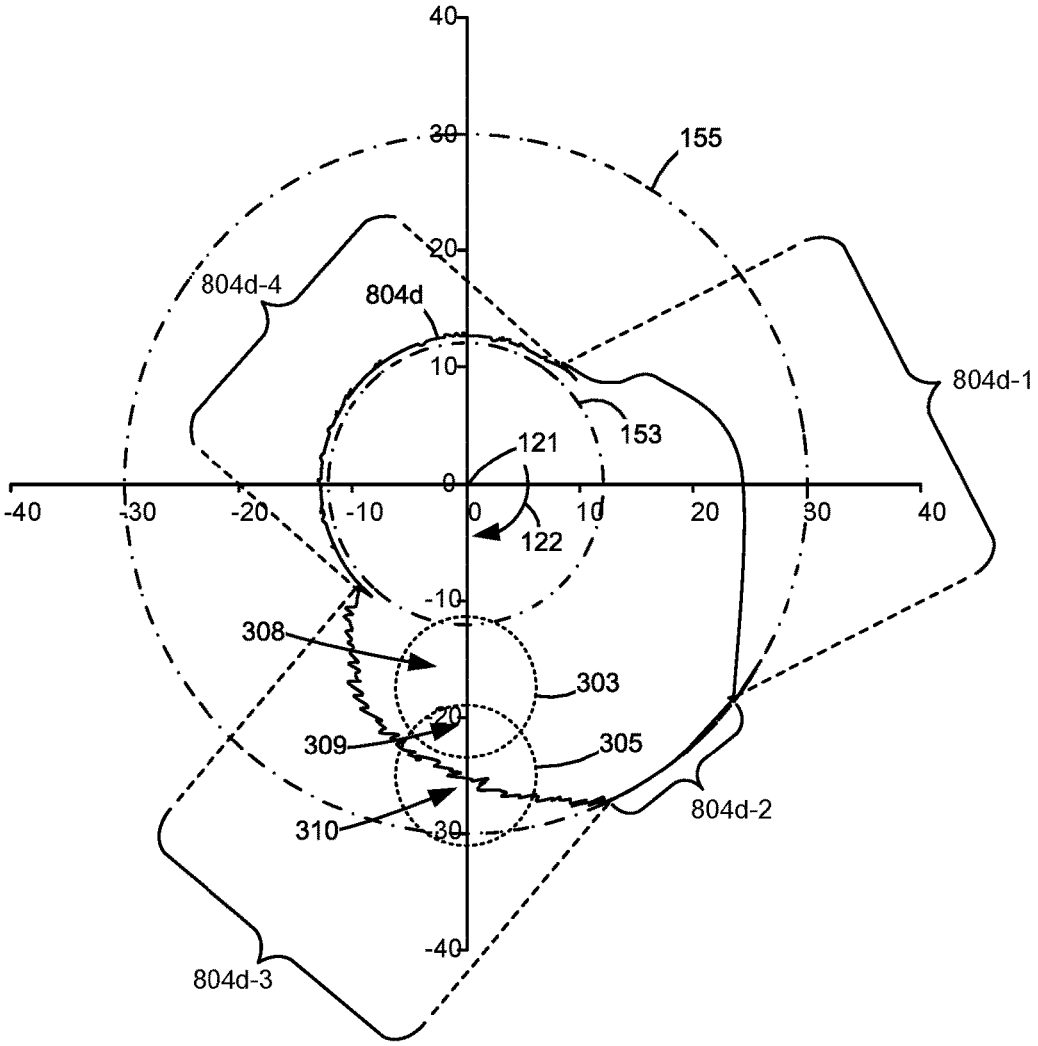

FIG. 8D shows the motion of sense paddle 150 when the toner level in toner reservoir 104 is very low, containing approximately 36 grams of toner in the example embodiment illustrated. Line 804*d* represents the radial positions of magnet 160*a* relative to rotational axis 121 of shaft 120 for one complete revolution of shaft 120. As shown in FIG. 8D, when the toner level in toner reservoir 104 is very low, after sense paddle 150 passes the vertically upward position, sense paddle 150 falls forward in operative rotational direction 122 (as represented by region 804*d*-1 of line 804*d* where the radius of magnet 160*a* is between maximum and minimum radii 153, 155) and reaches forward stop 152. Sense paddle 150 remains at forward stop 152 (as represented by region 804*d*-2 of line 804*d* where the radius of magnet 160*a* closely tracks with maximum radius 153) until leading face 158 of sense paddle 150 reaches the toner in reservoir 104. Sense paddle 150 remains on top of the toner in reservoir 104 (as represented by region 804*d*-3 of line 804*d* where the radius of magnet 160*a* is between maximum and minimum radii 153, 155) until rearward stop 154 contacts sense paddle 150 and pushes sense paddle 150 through the toner and back up to the vertically upward position (as represented by region 804*d*-4 of line 804*d* where the radius of magnet 160*a* closely tracks with minimum radius 155). In the example embodiment illustrated, when the toner level in toner reservoir 104 is very low, magnet 160*a* is detected in sensing zone 310 as shaft 120 rotates, i.e., magnetic sensor 304 detects magnet 160*a* within sense radius 305 but magnetic sensor 302 does not detect magnet 160*a* within sense radius 303.

Figure 9:
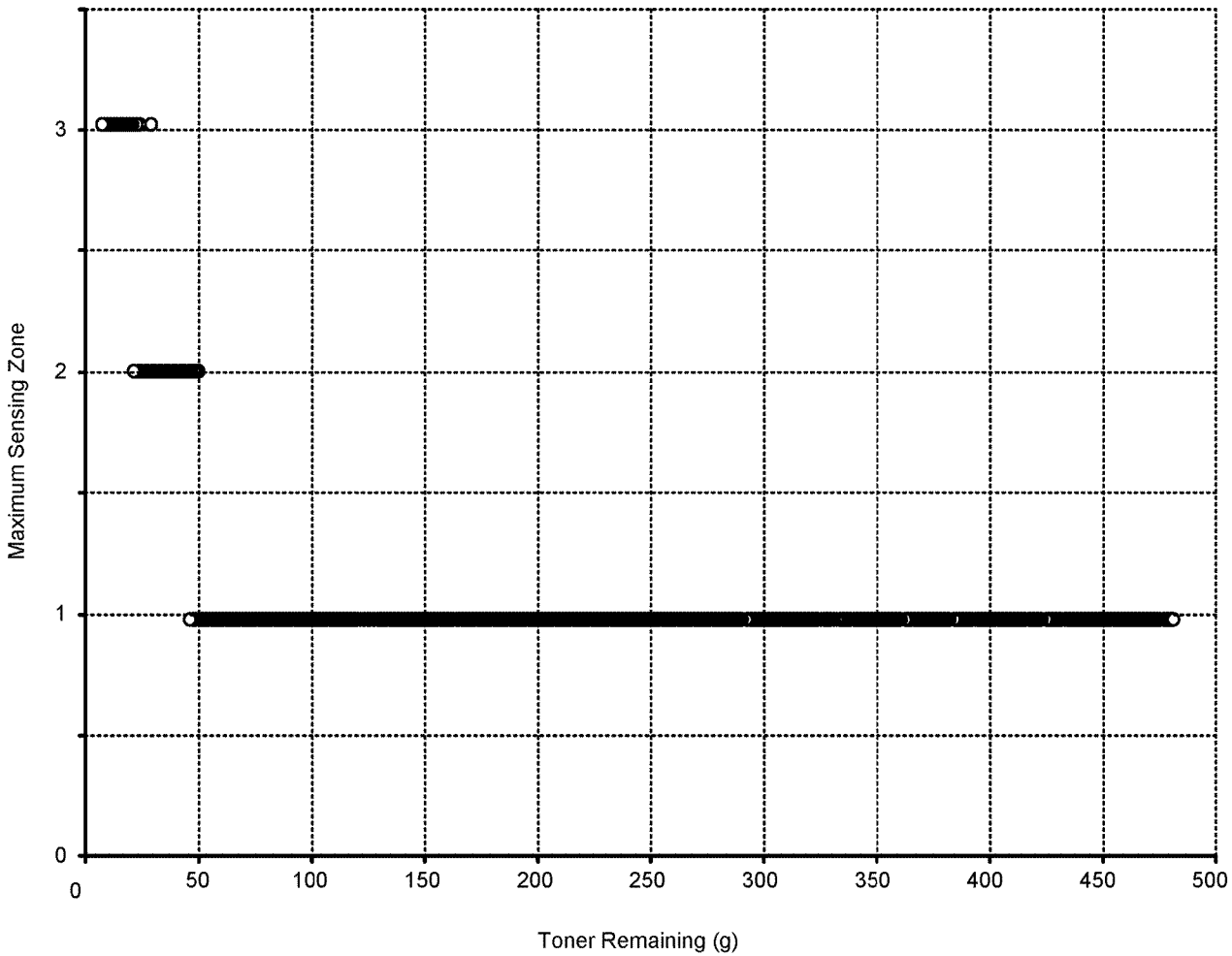
FIG. 9 is a graph of a maximum sensing zone of magnetic sensors of the system of FIG. 7 versus the toner level in the toner cartridge according to one example embodiment.

FIG. 9 illustrates the maximum sensing zone (1, 2 or 3, corresponding to sensing zones 308, 309, 310 illustrated in FIG. 7, respectively) that magnet 160*a* is detected in during each revolution of shaft 120 versus the amount of toner remaining (in grams) in reservoir 104. For most of the life of toner cartridge 100, toner in reservoir 104 tends to prevent sense paddle 150 from reaching the vertically downward position ahead of rearward stop 154 such that magnet 160*a* is detected in sensing zone 1 (corresponding to sensing zone 308 illustrated in FIG. 7) for most of the life of toner cartridge 100 as illustrated in FIG. 9. As more toner is fed from reservoir 104 and the toner level in reservoir 104 gets low, the radius of magnet 160*a* when magnet 160*a* passes the vertically downward position gradually increases such that magnet 160*a* is detected in sensing zone 2 (corresponding to sensing zone 309 illustrated in FIG. 7) and eventually in sensing zone 3 (corresponding to sensing zone 310 illustrated in FIG. 7) as illustrated in FIG. 9. In some embodiments, in order to account for variations in the toner distribution within reservoir 104 and to minimize false readings, rules may be established (e.g., in software) to maintain an "official" sensing zone level. For example, it may be established that the official sensing zone level never decrements and that the official sensing zone level is only incremented after a predetermined number of consecutive readings occur at the next sensing zone. For example, the official sensing zone level may only increment from one sensing zone to the next sensing zone after magnetic sensors 302, 304 detect magnet 160*a* in the next sensing zone on four consecutive revolutions of shaft 120. This helps ensure that the detected increase in the sensing zone is due to a decrease in the amount of toner in reservoir 104 and not other factors, such as a non-uniform distribution of toner in reservoir 104 occurring, for example, if toner cartridge 100 is removed from image forming device 22 and tipped toward end wall 110 or end wall 111 of housing 102.

The magnetic zone sensed by magnetic sensors 302, 304 may be used to estimate the amount of toner remaining in reservoir 104. The data from magnetic sensors 302, 304 may be used by controller 28 or other processing circuitry in communication with controller 28, such as processing circuitry 45, to aid in determining the amount of toner remaining in reservoir 104. In one embodiment, the initial amount of toner in reservoir 104 is recorded in memory associated with processing circuitry 45 upon filling the toner cartridge 100. Accordingly, upon installing toner cartridge 100 in image forming device 22, the processing circuitry determining the amount of toner remaining in reservoir 104 is able to determine the initial toner level in reservoir 104. Alternatively, each toner cartridge 100 for a particular type of image forming device 22 may be filled with the same amount of toner so that the initial toner level in reservoir 104 used by the processing circuitry may be a fixed value for all toner cartridges 100. The processing circuitry then estimates the amount of toner remaining in reservoir 104 as toner is fed from toner cartridge 100 to imaging unit 200 based on one or more operating conditions of image forming device 22 and/or toner cartridge 100. In one embodiment, the amount of toner remaining in reservoir 104 is approximated based on an empirically derived feed rate of toner from toner reservoir 104 when shaft 120 and auger 138 are rotated to deliver toner from toner cartridge 100 to imaging unit 200. In this embodiment, the estimate of the amount of toner remaining is decreased based on the amount of rotation of the drive motor of image forming device 22 that provides rotational force to drive coupler 140 of toner cartridge 100 as determined by the processing circuitry. In another embodiment, the estimate of the amount of toner remaining is decreased based on the number of printable elements (pels) printed using the toner from toner cartridge 100 while toner cartridge 100 is installed in image forming device 22. In another embodiment, the estimate of the amount of toner remaining is decreased based on the number of pages printed.

The amount of toner remaining in reservoir 104 where the magnetic zone sensed by magnetic sensors 302, 304 (such as the official sensing zone level discussed above) increments may be determined empirically for a particular toner cartridge design. As a result, each time the magnetic zone sensed by magnetic sensors 302, 304 increments (e.g., from zone 1 to zone 2 or from zone 2 to zone 3 as illustrated in FIG. 9), the processing circuitry may adjust the estimate of the amount of toner remaining in reservoir 104 based on the empirically determined amount of toner associated with the incrementing of the magnetic zone sensed.

For example, the toner level in reservoir 104 can be approximated by starting with the initial amount of toner supplied in reservoir 104 and reducing the estimate of the amount of toner remaining in reservoir 104 as toner from reservoir 104 is consumed. As discussed above, the estimate of the toner remaining may be decreased based on one or more conditions such as the number of rotations of the drive motor, drive coupler 140 or shaft 120, the number of pels printed, the number of pages printed, etc. The estimated amount of toner remaining may be recalculated when the magnetic zone sensed by magnetic sensors 302, 304 increases from zone 1 to zone 2 as illustrated in FIG. 9. In one embodiment, this includes replacing the estimate of the amount of toner remaining with the empirical value associated with the increase from sensing zone 1 to sensing zone 2. In another embodiment, the recalculation gives weight to both the present estimate of the amount of toner remaining and the empirical value associated with the increase from sensing zone 1 to sensing zone 2. The revised estimate of the amount of toner remaining in reservoir 104 is then decreased as toner from reservoir 104 is consumed using one or more conditions as discussed above. The estimated amount of toner remaining may be recalculated again when the magnetic zone sensed by magnetic sensors 302, 304 increases from zone 2 to zone 3 as illustrated in FIG. 9. As discussed above, this may include replacing the estimate of the amount of toner remaining or recalculating the estimate giving weight to both the present estimate of the amount of toner remaining and the empirical value associated with the increase from sensing zone 2 to sensing zone 3. This process may be repeated based on the number of magnetic sensors present until reservoir 104 is out of usable toner. In one embodiment, the present estimate of the amount of toner remaining in reservoir 104 is stored in memory associated with processing circuitry 45 of toner cartridge 100 so that the estimate travels with toner cartridge 100 in case toner cartridge 100 is removed from one image forming device 22 and installed in another image forming device 22.

In this manner, the detection of the motion of magnet 160*a* may serve as a correction for an estimate of the toner level in reservoir 104 based on other conditions such as an empirically derived feed rate of toner or the number of pels or pages printed as discussed above to account for variability and to correct potential error in such an estimate. For example, an estimate of the toner level based on conditions such as an empirically derived feed rate of toner or the number of pels or pages printed may drift from the actual amount of toner remaining in reservoir 104 over the life of toner cartridge 100, i.e., a difference between an estimate of the toner level and the actual toner level may tend to increase over the life of toner cartridge 100. Recalculating the estimate of the amount of toner remaining based on the motion of magnet 160*a* helps correct this drift to provide a more accurate estimate of the amount of toner remaining in reservoir 104.

It will be appreciated that any suitable number of magnetic sensors may be used as discussed above depending on how many recalculations of the estimate of the amount of toner remaining are desired. For example, more than two magnetic sensors may be used where recalculation of the estimated toner level is desired more frequently. Further, the radial positions of magnetic sensors 302, 304 may be selected in order to sense particular toner levels desired (e.g., 300 grams of toner remaining, 100 grams of toner remaining, etc.).

Figure 10:
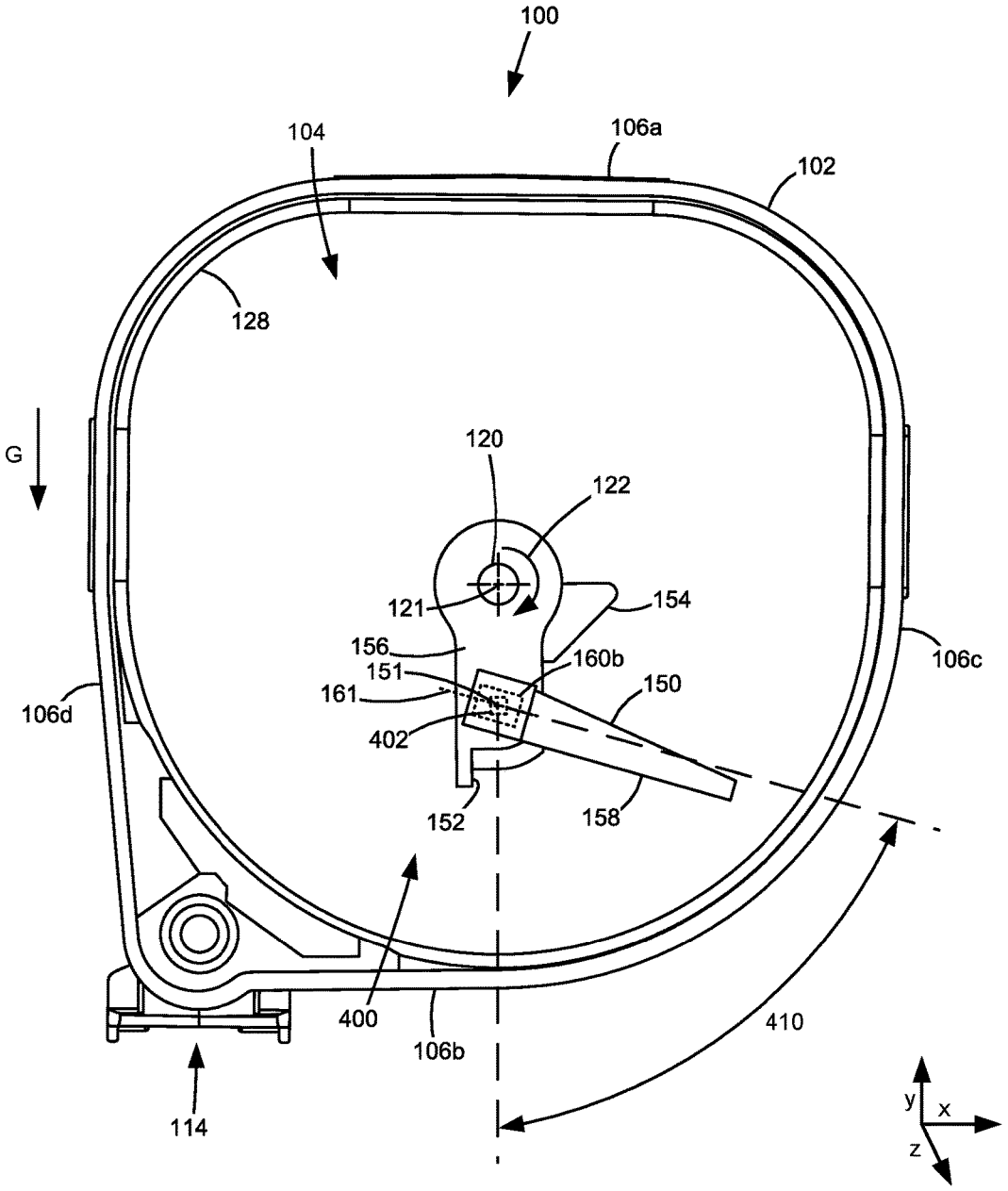
FIG. 10 is a cross-sectional view of the toner cartridge depicting a system for detecting an amount of toner remaining in the toner cartridge according to a second example embodiment.

FIG. 10 illustrates a system 400 for detecting the motion of magnet 160*b* of sense paddle 150 in order to estimate the amount of toner in reservoir 104 according to another example embodiment. System 400 utilizes only magnet 160*b* of sense paddle 150. Accordingly, magnet 160*a* may be omitted from system 400 as shown in FIG. 10. In the example embodiment illustrated, magnet 160*b* is cylindrically shaped and is magnetized along a longitudinal axis 161 of the cylinder such that one end of the cylinder is a north pole and the other end of the cylinder is a south pole. In this embodiment, the center of magnet 160*b* lies on pivot axis 151 of sense paddle 150 and magnet 160*b* is mounted on sense paddle 150 such that longitudinal axis 161 of magnet 160*b* is perpendicular to pivot axis 151 of sense paddle 150. In the example embodiment illustrated, longitudinal axis 161 of magnet 160*b* is parallel to leading face 158 of sense paddle 150.

System 400 includes a magnetic sensor 402 preferably positioned outside of reservoir 104. Magnetic sensor 402 permits detection of the orientation of magnet 160*b* and sense paddle 150 when magnet 160*b* passes magnetic sensor 402 in order to determine the amount of toner in reservoir 104. As discussed above, magnetic sensor 402 may be mounted on housing 102 of toner cartridge 100 or on a portion of image forming device 22 adjacent to housing 102 when toner cartridge 100 is installed in image forming device 22. Magnetic sensor 402 is positioned near or on the outer surface of housing 102 such that magnet 160*b* passes in close proximity to sensor 402 as shaft 120 rotates. In the example embodiment illustrated, magnetic sensor 402 is positioned adjacent to or on end wall 110 of housing 102.

Magnetic sensor 402 is positioned at the radius of pivot axis 151 of sense paddle 150 relative to rotational axis 121 of shaft 120 such that pivot axis 151 of sense paddle 150 passes adjacent to magnetic sensor 402 once per revolution of shaft 120. In the embodiment illustrated, magnetic sensor 402 is positioned along a vertically downward radius from rotational axis 121 of shaft 120 such that magnet 160*b* is closest to magnetic sensor 402 as magnet 160*b* passes the vertically downward position. In this embodiment, magnetic sensor 402 is configured to measure a magnitude of each of the three-dimensional magnetic field components ($B_x$, $B_y$, $B_z$) of the magnetic field of magnet 160*b*. For example, magnetic sensor 402 may be a three-axis magnetometer, such as a MLX90393 TRIAXIS® micropower magnetometer available from Melexis N.V., leper, Belgium. In the example embodiment illustrated, the x-axis is the left-right dimension as viewed in FIG. 10, the y-axis is the up-down dimension as viewed in FIG. 10, and the z-axis is the dimension normal to the plane of FIG. 10, i.e., along rotational axis 121 of shaft 120. In one embodiment, magnetic sensor 402 includes an analog-to-digital converter that permits the magnetic sensor 402 to output integer values for each of the three magnetic field components ($B_x$, $B_y$, $B_z$). Controller 28 or other processing circuitry in communication with controller 28, such as processing circuitry 45, may convert the integer values to Gauss values and calculate the total magnitude of the magnetic field of magnet 160*b* (IBI) from the three magnetic field components ($B_x$, $B_y$, $B_z$). In the example embodiment illustrated, the total magnitude of the magnetic field of magnet 160*b* (IBI) peaks when magnet 160*b* is at its closest position to magnetic sensor 402, when arms 156 are in a vertically downward position (6:00 position). In this embodiment, the magnitude of the z-component of the magnetic field of magnet 160*b* goes to zero when arms 156 are in a vertically downward position (6:00 position), when magnet 160*b* is aligned with magnetic sensor 402 in the x and y dimensions. Accordingly, the processing circuitry may calculate the angle of magnet 160*b* relative to a predetermined reference using trigonometric equations, such as the vertically downward position as shown in FIG. 10 by determining the $\arctan(B_x/B_y)$. In the example embodiment illustrated, the angle of magnet 160*b* matches the angle of leading face 158 of sense paddle 150 since longitudinal axis 161 of magnet 160*b* is parallel to leading face 158 of sense paddle 150.*d*

The processing circuitry determining the amount of toner remaining in reservoir 104 may continuously monitor the total magnitude of the magnetic field of magnet 160*b* sensed by magnetic sensor 402. When the total magnitude of the magnetic field peaks, the processing circuitry may conclude that magnet 160*b* is at its closest position to magnetic sensor 402 for each revolution of shaft 120. At this position, the processing circuitry may then calculate an angle 410 of magnet 160*b* and sense paddle 150 relative to a predetermined reference.

Figure 11:
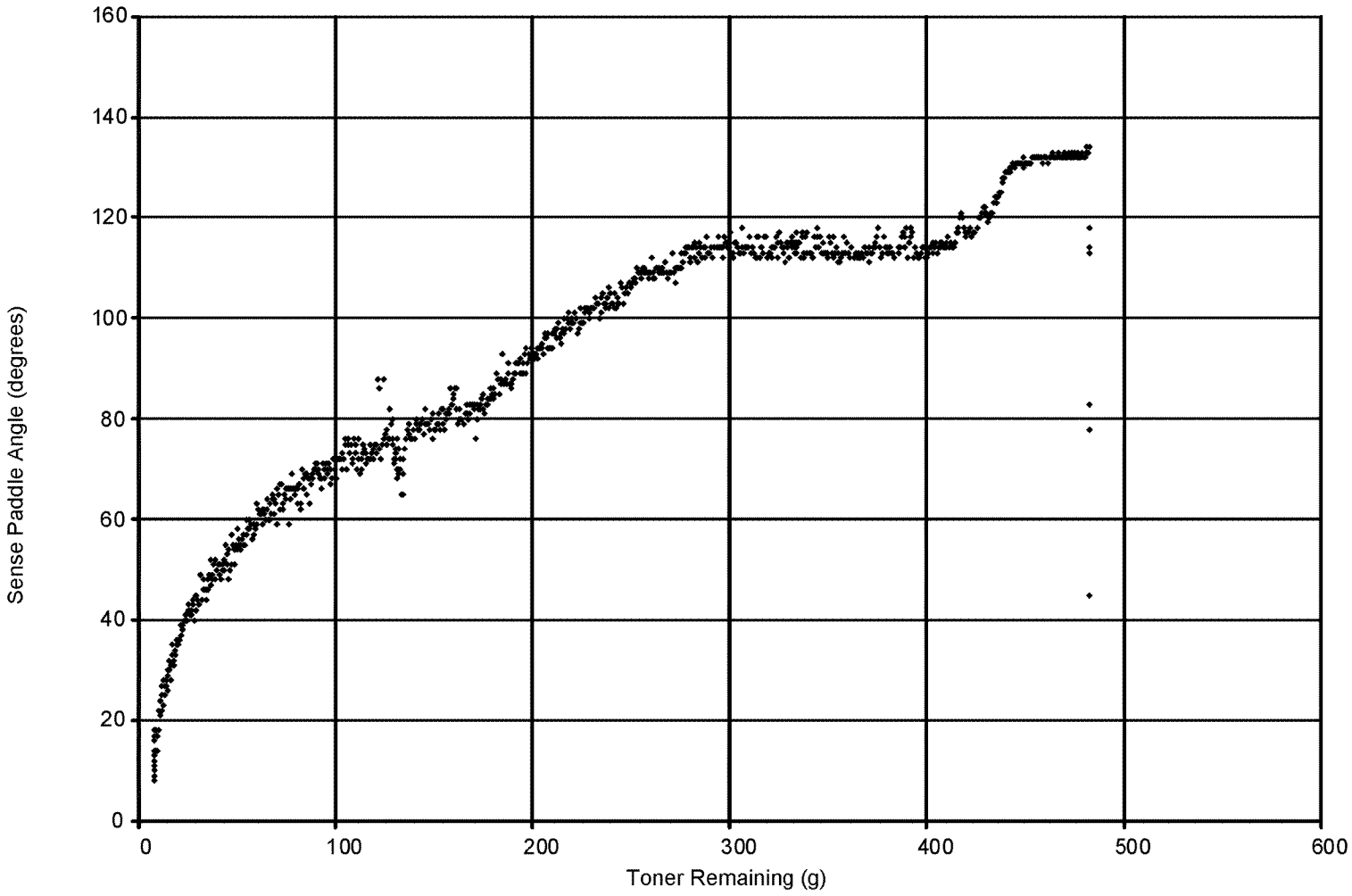
FIG. 11 is a graph of an angle of the sense paddle when a magnetic sensor of the system of FIG. 10 detects the sense paddle versus the toner level in the toner cartridge according to one example embodiment.

FIG. 11 illustrates how the angle of magnet 160*b* and sense paddle 150 changes as the toner level of reservoir 104 decreases according to one example embodiment. FIG. 11 shows the angle of sense paddle 150 (in degrees) versus the amount of toner remaining (in grams) in reservoir 104. As shown in FIG. 11, when reservoir 104 is full of toner, sense paddle 150 remains at its maximum angle (approximately 135 degrees in the embodiment illustrated) positioned against rearward stops 154. As the toner level in reservoir 104 decreases, the angle of sense paddle 150 as magnet 160*b* passes the vertically downward position gradually decreases and plateaus at approximately 112 to 118 degrees in the embodiment illustrated. Once toner reservoir 104 is half-full (approximately 240 grams in the embodiment illustrated), the angle of sense paddle 150 as magnet 160*b* passes the vertically downward position steadily decreases as additional toner is fed from reservoir 104 until the angle of sense paddle approaches zero when no usable toner remains.

The angle of magnet 160*b* and sense paddle 150 determined from magnetic sensor 402 may be used to estimate the amount of toner remaining in reservoir 104. The angle of magnet 160*b* and sense paddle 150 may be used in combination with one or more conditions such as the number of rotations of the drive motor, drive coupler 140 or shaft 120, the number of pels printed, the number of pages printed, etc. to estimate the amount of toner remaining in reservoir 104 as discussed above. Alternatively, because the angle of magnet 160*b* and sense paddle 150 tends to provide an analog reading of the toner remaining in reservoir 104, especially when reservoir 104 is half-full or less, the angle of magnet 160*b* and sense paddle 150 may be used in lieu of other operating conditions to estimate the amount of toner remaining in reservoir 104. For example, a simple look up table may be prepared based on an empirical determined relationship between the angle of magnet 160*b* and sense paddle 150 and the amount of toner remaining in reservoir 104 such that the processing circuitry may estimate the amount of toner remaining in reservoir 104 based on the calculated angle of magnet 160*b* and sense paddle 150 when magnet 160*b* is at its closest position to magnetic sensor 402. Alternatively, a polynomial equation may be fit to the empirically determined relationship between the angle of magnet 160*b* and sense paddle 150 and the amount of toner remaining in reservoir 104.

Figure 12A:
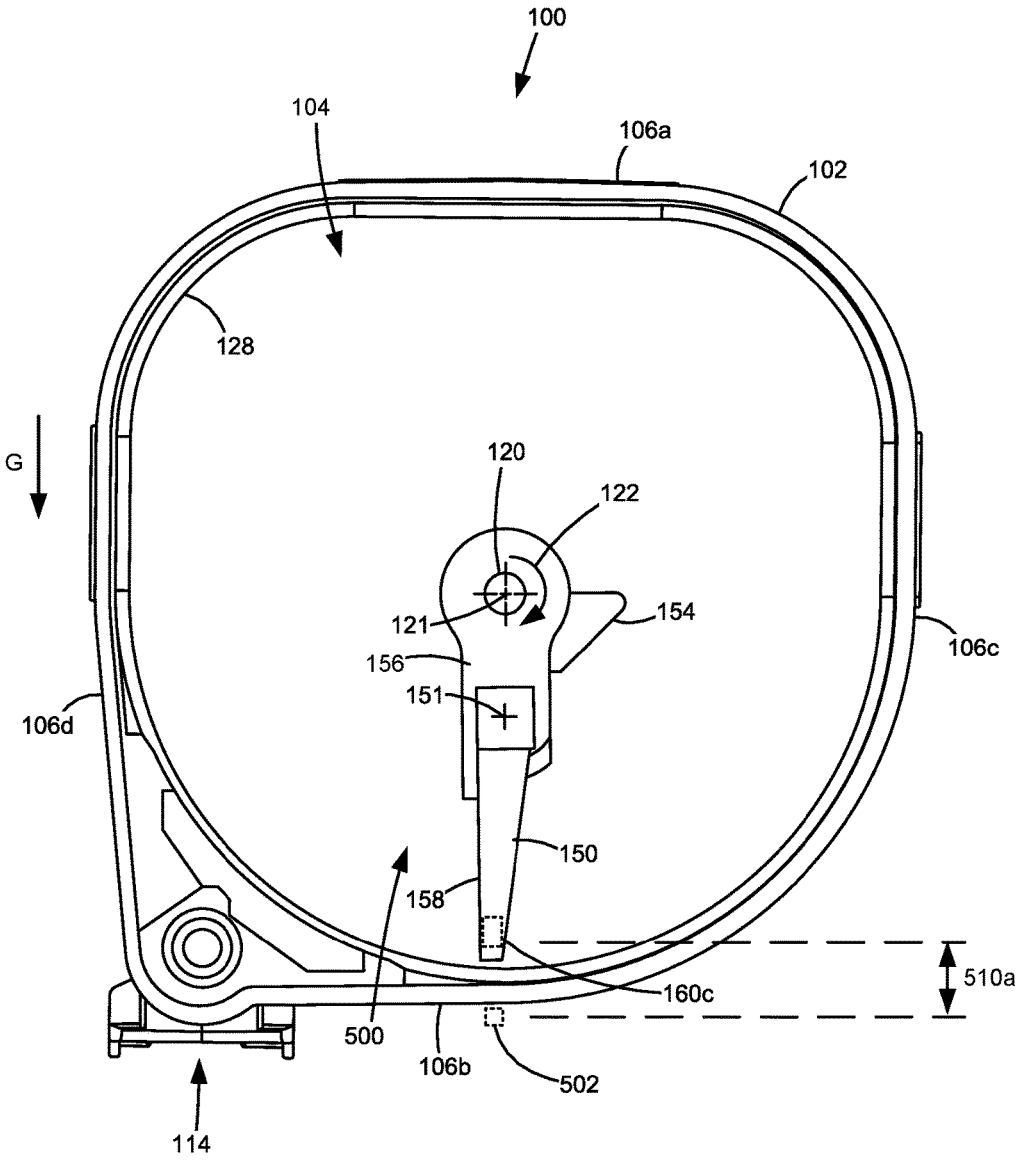
FIGS. 12A and 12B are cross-sectional views of the toner cartridge depicting a system for detecting an amount of toner remaining in the toner cartridge according to a third example embodiment.
Figure 12B:
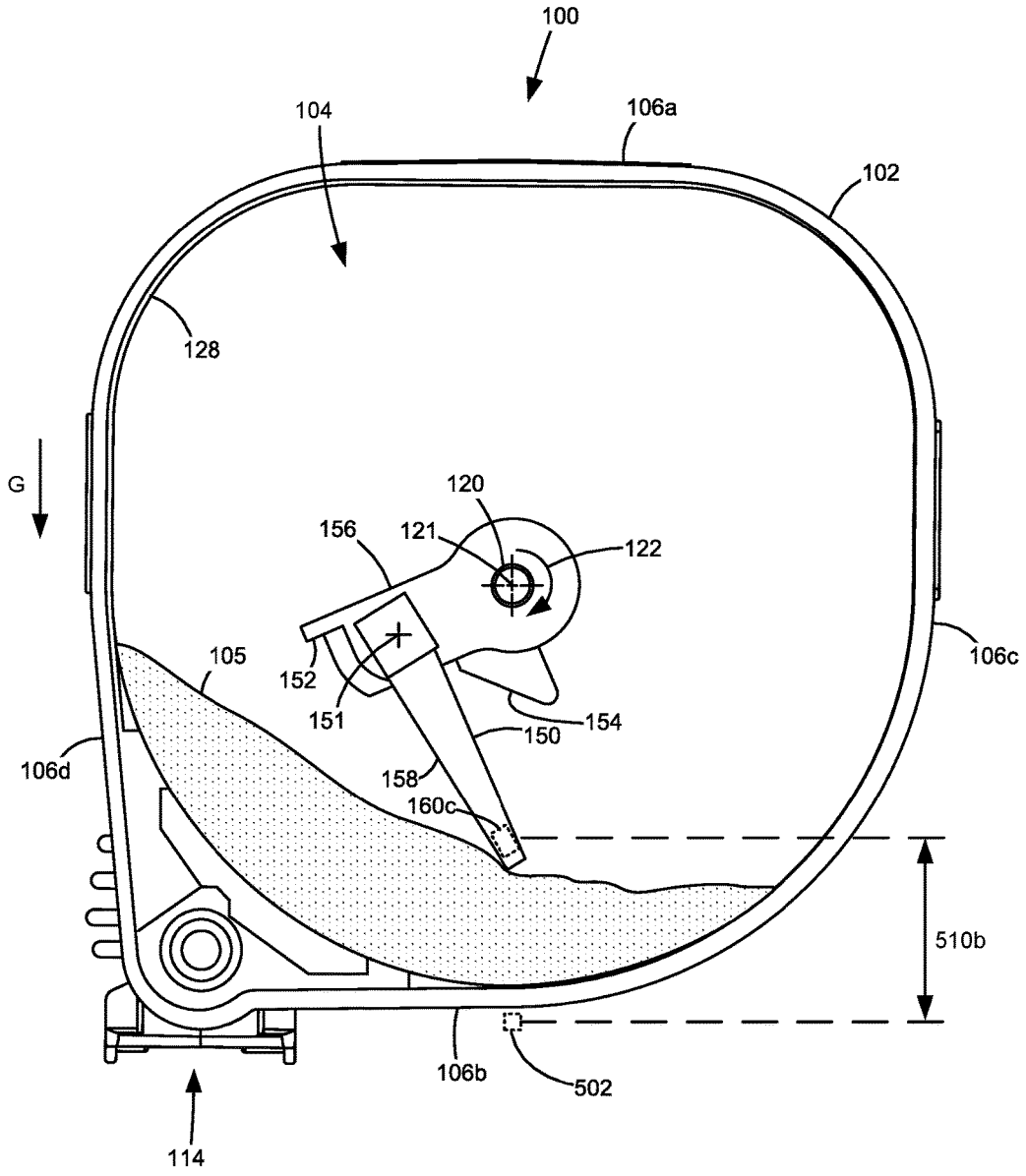

FIGS. 12A and 12B illustrate a system 500 for detecting the motion of a magnet 160*c* of sense paddle 150 in order to estimate the amount of toner in reservoir 104 according to another example embodiment. Magnet 160*c* is positioned near a distal end 164 of sense paddle 150 relative to pivot axis 151. System 500 utilizes only magnet 160*c*. Accordingly, magnets 160*a* and 160*b* may be omitted from system 500 as shown in FIGS. 12A and 12B. System 500 includes a magnetic sensor 502 preferably positioned outside of reservoir 104. Magnetic sensor 502 permits detection of the height of magnet 160*c* above or below magnetic sensor 502 as magnet 160*c* passes magnetic sensor 502 in order to determine the amount of toner in reservoir 104. Magnetic sensor 502 is preferably positioned vertically lower than rotational axis 121 of shaft 120 and may be positioned higher or lower than bottom 106*b* of housing 102. In the embodiment illustrated, magnetic sensor 502 is positioned along a vertically downward radius from rotational axis 121 of shaft 120 such that magnet 160*c* is closest to magnetic sensor 502 as magnet 160*c* passes the vertically downward position. In this embodiment, magnetic sensor 502 is configured to measure a magnitude of each of the three-dimensional magnetic field components ($B_x$, $B_y$, $B_z$) of the magnetic field of magnet 160*b*, such as a three-axis magnetometer as discussed above. As discussed above, magnetic sensor 502 may be mounted on housing 102 of toner cartridge 100 or on a portion of image forming device 22 adjacent to housing 102 when toner cartridge 100 is installed in image forming device 22. In the example embodiment illustrated, magnetic sensor 502 is positioned adjacent to or on bottom 106*b* of housing 102. In this embodiment, magnet 160*c* is axially aligned with magnetic sensor 502. Alternatively, magnetic sensor 502 may be positioned adjacent to or on end wall 110 of housing 102.

As discussed above, when the processing circuitry determining the amount of toner remaining in reservoir 104 determines that the total magnitude of the magnetic field of magnet 160*c* peaks, the processing circuitry may conclude that magnet 160*c* is at its closest position to magnetic sensor 502 for each revolution of shaft 120. At this position, the processing circuitry may determine the height of magnet 160*c* relative to magnetic sensor 502 from the three magnetic field components ($B_x$, $B_y$, $B_z$). FIG. 12A illustrates system 500 where no toner is present in reservoir 104 resulting in a first height 510*a* of magnet 160*c* relative to magnetic sensor 502. FIG. 12B illustrates system 500 with toner in reservoir 104 resulting in a second height 510*b* of magnet 160*c* relative to magnetic sensor 502 that is greater than height 510*a*. As discussed above, the height of magnet 160*c* relative to magnetic sensor 502 may be used in combination with or instead of one or more operating conditions to estimate the amount of toner remaining in reservoir 104 based on an empirically determined relationship between the height of magnet 160*c* and the amount of toner remaining in reservoir 104.

Accordingly, the present disclosure includes various systems for measuring an amount of toner remaining in a reservoir. Because the motion of sense paddle 150 is detectable by a sensor outside of reservoir 104, sense paddle 150 may be provided without an electrical or mechanical connection to the outside of housing 102 (other than shaft 120). This avoids the need to seal an additional connection into reservoir 104, which could be susceptible to leakage and could cause unwanted friction on sense paddle 150 potentially interfering with the motion of sense paddle 150. Positioning the magnetic sensor(s) of systems 300, 400, 500 outside of reservoir 104 reduces the risk of toner contamination, which could damage the sensor(s). The magnetic sensor(s) of systems 300, 400, 500 may also be used to detect the installation of toner cartridge 100 in image forming device 22 and to confirm that shaft 120 is rotating properly thereby eliminating the need for additional sensors to perform these functions.

Although the example embodiments discussed above utilize a sense paddle 150 in the reservoir of toner cartridge 100, it will be appreciated that a sense paddle 150 having one or more magnets may be used to determine the toner level in any reservoir or sump storing toner in image forming device 22 such as, for example, a reservoir of the imaging unit or a storage area for waste toner. Further, although the example embodiments discussed above discuss a system for determining a toner level, it will be appreciated that this system and the methods discussed herein may be used to determine the level of a particulate material other than toner such as, for example, grain, seed, flour, sugar, salt, etc.

Although the example embodiment discussed above includes a pair of replaceable units in the form of toner cartridge 100 and imaging unit 200, it will be appreciated that the replaceable unit(s) of the image forming device may employ any suitable configuration as desired. For example, in one embodiment, the main toner supply for the image forming device, the developer unit and the cleaner unit are housed in one replaceable unit. In another embodiment, the main toner supply for the image forming device and the developer unit are provided in a first replaceable unit and the cleaner unit is provided in a second replaceable unit. Further, although the example image forming device 22 discussed above includes one toner cartridge and corresponding imaging unit, in the case of an image forming device configured to print in color, separate replaceable units may be used for each toner color needed. For example, in one embodiment, the image forming device includes four toner cartridges and four corresponding imaging units, each toner cartridge containing a particular toner color (e.g., black, cyan, yellow and magenta) and each imaging unit corresponding with one of the toner cartridges to permit color printing.

Further, it will be appreciated that the architecture and shape of toner cartridge 100 illustrated in FIG. 2 is merely intended to serve as an example. Those skilled in the art understand that toner cartridges, and other toner reservoirs, may take many different shapes and configurations. Similarly, skilled artisans also appreciate that shaft 120, paddles 126 and sense paddle 150 may take many different shapes and configurations depending on the toner reservoir they are employed in. In particular, sense paddle 150 may take many different shapes and configurations so long as one or more magnets operatively connected to sense paddle 150 are positioned to permit toner level sensing according to one or more systems such as systems 300, 400, 500 described herein.

The foregoing description illustrates various aspects of the present disclosure. It is not intended to be exhaustive. Rather, it is chosen to illustrate the principles of the present disclosure and its practical application to enable one of ordinary skill in the art to utilize the present disclosure, including its various modifications that naturally follow. All modifications and variations are contemplated within the scope of the present disclosure as determined by the appended claims. Relatively apparent modifications include combining one or more features of various embodiments with features of other embodiments.

The invention claimed is:

1. A toner level detection assembly for an electrophotographic image forming device, comprising:

a reservoir for storing toner;

a rotatable shaft positioned within the reservoir and having an axis of rotation;

a magnet connected to the rotatable shaft and rotatable with the rotatable shaft around the axis of rotation, the magnet is pivotable independent of the rotatable shaft about a pivot axis that is spaced radially from the axis of rotation such that an orientation of the magnet relative to the pivot axis varies as the magnet pivots about the pivot axis;

a magnetic sensor positioned to sense a magnetic field of the magnet at a point in a rotational path of the magnet around the axis of rotation and configured to measure an orientation of the magnetic field of the magnet at the point in the rotational path of the magnet; and processing circuitry in communication with the magnetic sensor configured to determine an estimate of an amount of toner in the reservoir correlating with the measured orientation of the magnetic field of the magnet at the point in the rotational path of the magnet.

2. The toner level detection assembly of claim 1, wherein the magnetic sensor is configured to measure a magnitude of each three-dimensional magnetic field component of the magnetic field of the magnet at the point in the rotational path of the magnet and the processing circuitry is configured to determine the estimate of the amount of toner in the reservoir correlating with the measured magnitudes of the three-dimensional magnetic field components of the magnetic field of the magnet at the point in the rotational path of the magnet.

3. The toner level detection assembly of claim 1, wherein the processing circuitry is configured to determine an angle of the magnet at the point in the rotational path of the magnet based on the measured orientation of the magnetic field of the magnet at the point in the rotational path of the magnet and to determine the estimate of the amount of toner in the reservoir correlating with the determined angle of the magnet at the point in the rotational path of the magnet.

4. The toner level detection assembly of claim 1, wherein the magnetic sensor is positioned along a vertically downward radius from the axis of rotation.

5. A toner level detection assembly for an electrophotographic image forming device, comprising:

a reservoir for storing toner;

a rotatable shaft positioned within the reservoir and having an axis of rotation;

a magnet connected to the rotatable shaft and rotatable with the rotatable shaft around the axis of rotation, the magnet is pivotable independent of the rotatable shaft about a pivot axis that is spaced radially from the axis of rotation such that an orientation of the magnet relative to the pivot axis varies as the magnet pivots about the pivot axis;

a magnetic sensor positioned to sense a magnetic field of the magnet at a point in a rotational path of the magnet around the axis of rotation and configured to measure a magnitude of each three-dimensional magnetic field component of the magnetic field of the magnet at the point in the rotational path of the magnet; and processing circuitry in communication with the magnetic sensor configured to determine an angle of the magnet at the point in the rotational path of the magnet based on the measured magnitudes of the three-dimensional magnetic field components of the magnetic field of the magnet at the point in the rotational path of the magnet and to determine an estimate of an amount of toner in the reservoir correlating with the determined angle of the magnet at the point in the rotational path of the magnet.

6. The toner level detection assembly of claim 5, wherein the processing circuitry is further configured to detect a peak in a total magnitude of the magnetic field of the magnet and to determine the angle of the magnet at the point in the rotational path of the magnet corresponding to the detected peak in the total magnitude of the magnetic field of the magnet.

7. The toner level detection assembly of claim 5, wherein the magnetic sensor is positioned along a vertically downward radius from the axis of rotation.

8. A method for estimating an amount of toner in a reservoir of an electrophotographic image forming device, comprising:

rotating a shaft positioned in the reservoir;

by rotating the shaft, rotating around an axis of rotation of the shaft a magnet that is pivotable independent of the shaft about a pivot axis that is spaced radially from the axis of rotation, the magnet positioned at the pivot axis;

detecting a magnetic field of the magnet at a point in a rotational path of the magnet around the axis of rotation;

determining an orientation of the magnetic field of the magnet at the point in the rotational path of the magnet;

determining an angle of the magnet at the point in the rotational path of the magnet based on the determined orientation of the magnetic field of the magnet at the point in the rotational path of the magnet; and estimating the amount of toner in the reservoir based on a predetermined correlation with the determined angle of the magnet at the point in the rotational path of the magnet.

9. The method of claim 8, wherein determining the orientation of the magnetic field of the magnet at the point in the rotational path of the magnet includes determining a magnitude of each three-dimensional component of the magnetic field of the magnet at the point in the rotational path of the magnet and determining the angle of the magnet at the point in the rotational path of the magnet includes determining the angle of the magnet at the point in the rotational path of the magnet based on the determined magnitudes of the three-dimensional components of the magnetic field of the magnet at the point in the rotational path of the magnet.

10. The method of claim 8, further comprising determining a total magnitude of the magnetic field of the magnet and detecting a peak in the total magnitude of the magnetic field of the magnet, wherein determining the angle of the magnet at the point in the rotational path of the magnet includes determining the angle of the magnet based on the determined orientation of the magnetic field of the magnet corresponding to the detected peak in the total magnitude of the magnetic field of the magnet.

* * * * *